US010427018B2

(12) United States Patent
Taylor et al.

(10) Patent No.: US 10,427,018 B2
(45) Date of Patent: Oct. 1, 2019

(54) GOLF CLUB HEAD WITH SOUND DAMPING

(71) Applicant: TAYLOR MADE GOLF COMPANY, INC., Carlsbad, CA (US)

(72) Inventors: Scott Taylor, Bonita, CA (US); Jason Issertell, Carlsbad, CA (US)

(73) Assignee: TAYLOR MADE GOLF COMPANY, INC., Carlsbad, CA (US)

( * ) Notice: Subject to any disclaimer, the term of this patent is extended or adjusted under 35 U.S.C. 154(b) by 495 days.

(21) Appl. No.: 15/172,042

(22) Filed: Jun. 2, 2016

(65) Prior Publication Data

US 2016/0367876 A1 Dec. 22, 2016

Related U.S. Application Data

(60) Provisional application No. 62/183,056, filed on Jun. 22, 2015.

(51) Int. Cl.

| | |
|---|---|
| ***A63B 53/04*** | (2015.01) |
| ***A63B 60/54*** | (2015.01) |
| ***A63B 60/52*** | (2015.01) |
| *A63B 60/00* | (2015.01) |

(52) U.S. Cl.

CPC ..... *A63B 60/54* (2015.10); *A63B 53/047* (2013.01); *A63B 60/52* (2015.10); *A63B 2053/042* (2013.01); *A63B 2053/0408* (2013.01); *A63B 2053/0429* (2013.01); *A63B 2053/0454* (2013.01); *A63B 2060/002* (2015.10)

(58) Field of Classification Search

CPC .... A63B 53/04; A63B 53/047; A63B 53/0475

See application file for complete search history.

(56) References Cited

U.S. PATENT DOCUMENTS

| | | | | | |
|---|---|---|---|---|---|
| 2,846,228 | A * | 8/1958 | Reach | A63B 53/04 | 473/332 |
| 4,883,274 | A * | 11/1989 | Hsien | A63B 53/04 | 473/335 |
| 4,938,470 | A * | 7/1990 | Antonious | A63B 53/04 | 473/242 |
| 5,014,993 | A * | 5/1991 | Antonious | A63B 53/04 | 473/350 |
| D319,091 | S * | 8/1991 | Antonious | D21/749 | |

(Continued)

*Primary Examiner* — William M Pierce

(74) *Attorney, Agent, or Firm* — Duane Morris LLP

(57) ABSTRACT

The present disclosure concerns embodiments of a badge and golf club head having a badge therein that can dampen the impact sound made when a hitting surface (a.k.a., face) of the golf club head impacts a golf ball. In one embodiment, a golf club head includes: a face portion surrounded by a topline portion, a toe portion, a sole portion and a heel portion, the face portion having a front striking surface and a back surface; and a badge coupled to the back surface of the face portion, the badge including a planar main body portion and at least one structural member extending outwardly from the main body portion, wherein the at least one structural member includes a lower portion and an upper portion disposed between the topline portion and lower portion, and wherein the at least one structural member has a maximum height, above the main body portion, at the lower portion and a minimum height at the upper portion.

24 Claims, 14 Drawing Sheets

(56) References Cited

U.S. PATENT DOCUMENTS

D327,720 S * 7/1992 Antonious ..... D21/748
D331,272 S * 11/1992 Antonious ..... D21/749
D332,478 S * 1/1993 Antonious ..... D21/749
5,595,552 A * 1/1997 Wright ..... A63B 53/04 473/332
D386,550 S * 11/1997 Wright ..... D21/759
D386,551 S * 11/1997 Solheim ..... D21/759
D387,405 S * 12/1997 Solheim ..... D21/759
5,695,411 A * 12/1997 Wright ..... A63B 53/04 473/332
5,921,869 A * 7/1999 Blough ..... A63B 53/04 473/291
6,811,496 B2 11/2004 Wahl et al.
6,855,066 B2 * 2/2005 Best ..... A63B 53/04 473/291
6,857,973 B2 * 2/2005 Wieland ..... A63B 53/047 473/342
6,887,164 B2 * 5/2005 Dewanjee ..... A63B 53/047 473/342
7,220,189 B2 * 5/2007 Wieland ..... A63B 53/0466 473/342
D554,215 S * 10/2007 Ruggiero ..... D21/759
D554,217 S * 10/2007 Ruggiero ..... D21/759
D554,218 S * 10/2007 Ruggiero ..... D21/759
7,338,387 B2 * 3/2008 Nycum ..... A63B 53/047 473/332
7,399,238 B2 * 7/2008 Hocknell ..... A63B 53/0466 473/342
D581,000 S * 11/2008 Nicolette ..... D21/749
D602,103 S * 10/2009 Jorgensen ..... D21/747
D621,893 S * 8/2010 Nicolette ..... D21/759
D635,627 S * 4/2011 Nicolette ..... D21/759
D643,492 S * 8/2011 Nicolette ..... D21/759
D654,547 S * 2/2012 Jertson ..... D21/747
8,267,807 B2 * 9/2012 Takechi ..... A63B 53/0475 473/332
8,449,408 B2 * 5/2013 Clausen ..... A63B 53/047 473/335
8,506,423 B2 * 8/2013 Oldknow ..... A63B 53/047 473/346
D691,685 S * 10/2013 Cyrulik ..... D21/759
8,657,700 B2 * 2/2014 Nicolette ..... A63B 53/047 473/291
8,753,230 B2 * 6/2014 Stokke ..... A63B 53/047 473/350
D708,688 S * 7/2014 Nicolette ..... D21/759
8,876,630 B2 * 11/2014 Takechi ..... A63B 53/047 473/332
8,920,258 B2 * 12/2014 Dolezel ..... A63B 53/04 473/324
8,920,261 B2 * 12/2014 Taylor ..... B23P 11/02 473/350
D725,732 S * 3/2015 Westrum ..... D21/759
9,079,080 B2 * 7/2015 Jertson ..... A63B 53/047
9,199,141 B2 * 12/2015 Cardani ..... A63B 53/047
D755,316 S * 5/2016 Stokke ..... D21/759
D763,986 S * 8/2016 Cardani ..... D21/759
9,517,393 B2 * 12/2016 Cardani ..... A63B 53/0475
9,901,792 B2 * 2/2018 Franklin ..... A63B 53/04
9,950,219 B2 * 4/2018 Larson ..... A63B 53/0466
10,046,211 B2 * 8/2018 Franklin ..... A63B 53/0487
2001/0001774 A1 * 5/2001 Antonious ..... A63B 53/04 473/349
2007/0117653 A1 * 5/2007 Yoneyama ..... A63B 53/0475 473/350
2010/0267463 A1 * 10/2010 Stites ..... A63B 53/047 473/291
2011/0028240 A1 * 2/2011 Wahl ..... A63B 53/047 473/346
2011/0053703 A1 * 3/2011 Stites ..... A63B 53/0466 473/291
2011/0124432 A1 * 5/2011 Oldknow ..... A63B 53/047 473/334
2011/0207551 A1 * 8/2011 Breier ..... A63B 53/047 473/332
2011/0275451 A1 11/2011 Chao et al.
2012/0289360 A1 * 11/2012 Breier ..... A63B 53/047 473/335
2013/0109500 A1 * 5/2013 Boyd ..... A63B 53/047 473/332
2013/0165257 A1 * 6/2013 Dipert ..... A63B 53/047 473/349
2013/0331201 A1 12/2013 Wahl et al.
2015/0133232 A1 5/2015 Taylor et al.
2016/0332043 A1 * 11/2016 Cardani ..... A63B 53/0475
2016/0332044 A1 * 11/2016 Daraskavich ..... A63B 53/0475
2017/0157474 A1 * 6/2017 Sander ..... A63B 53/0475
2018/0111028 A1 * 4/2018 Gonzalez ..... A63B 53/0475

* cited by examiner

| Iron | Mass | Axis | X+15 | X+10 | X+5 | X0 | X-5 | X-10 | X-15 | Y+15 | Y+10 | Y+5 | Y | Y-5 | Y-10 | Y-15 |
|---|---|---|---|---|---|---|---|---|---|---|---|---|---|---|---|---|
| 4-5 | 9 | I1 | 1401.6 | 983.6 | 693 | 766.8 | 930 | 1924.3 | 3881.2 | 2401.8 | 3920.8 | 6641.4 | 13256.3 | 1064.2 | - | - |
| | | I2 | 3642.3 | 3121.7 | 3101.7 | 3945.6 | 5135.2 | 7720.6 | 11924.9 | 19002.2 | 58481.2 | 111029.5 | 150810.7 | 8359.1 | - | - |
| 6-7 | 10.1 | I1 | 1012.3 | 632.2 | 527.1 | 617.8 | 753.1 | 1551.4 | 3369.4 | 2099.4 | 3578.2 | 5974.6 | 11811.2 | 285.4 | - | - |
| | | I2 | 2889.0 | 2285.3 | 2408.7 | 3159.6 | 4150.3 | 6534.9 | 12043.3 | 20638.6 | 58320.9 | 109272.5 | 141210.2 | 2827.2 | - | - |
| 8-PW | 11.6 | I1 | 652.8 | 520.2 | 403.8 | 482.6 | 550.7 | 1095.6 | 1938.0 | 1118.6 | 2056.0 | 3753.6 | 4218.1 | - | - | - |
| | | I2 | 2367.8 | 2039.0 | 2167.9 | 2918.5 | 3784.7 | 5695.1 | 9907.7 | 23517.8 | 61677.0 | 87382.8 | 61200.2 | - | - | - |

FIG. 10

GOLF CLUB HEAD WITH SOUND DAMPING

CROSS-REFERENCE TO RELATED APPLICATION

The present application claims priority to U.S. Provisional Patent Application No. 62/183,056, entitled "Golf Club Head" and filed on Jun. 22, 2015, which is incorporated by reference herein in its entirety.

FIELD OF THE INVENTION

The present disclosure concerns embodiments of a golf club head, and in particular, embodiments of an improved golf club head having structures for sound damping.

BACKGROUND

Cavity-back type golf club iron heads include a cavity behind the front face or striking surface of the club head. Typically, the position and overall size and shape of a cavity are selected to remove mass from the club head and/or to adjust the center of gravity of the club head. Such cavity-back iron heads assist a golfer by distributing much of the weight of the golf club head in the perimeter regions of the golf club head, making them more "forgiving" than non-cavity back golf club heads (e.g., traditional "blade" type irons). A golf club head that is more forgiving allows a golf ball to be struck slightly off center on the face of the golf club head with less adverse impact to the distance and/or accuracy of the golf ball flight. Thus, cavity-back type irons are very popular among non-professional and amateur players.

In addition to "forgiveness," the "feel" of a golf club is important to golfers. Although the "feel" of a golf club results from a combination of various factors (e.g., club head weight, weight distribution, aerodynamics of the club head, weight and flexibility of the shaft, etc.), it has been found that a significant factor that affects the perceived "feel" of a golf club to a user is the sound produced when the golf club head strikes a ball. If a club head makes a strange or unpleasant sound at impact, or a sound that is too loud, such sounds can translate to an unpleasant "feel" in the golfer's mind.

Manufacturers of cavity-back type golf clubs often place a badge or insert in the cavity for decorative purposes and/or for indicating the manufacturer name, logo, trademark, or the like. Additionally, it is known that a badge or insert may be used to achieve vibration and sound damping. Examples of such badges or inserts are disclosed in U.S. Pat. No. 8,920,261 entitled "Badge for Golf Club Head," assigned to Taylor Made Golf Company, Inc., and incorporated by reference herein in its entirety.

Historically, golf club irons had relatively thicker faces that allowed for relatively smaller amounts of deflection, which resulted in less vibration and sound generation when the face impacts a golf ball. Therefore, badges, inserts or medallions (collectively referred to herein as "badges") placed behind the front faces of such irons were typically primarily used for decorative design. As the front face of golf club heads have become thinner and their coefficients of restitution (COR) larger, however, the vibration and sound that can be produced when the front face impacts a golf ball has increased. Thus, vibration and sound damping has become more important for such types of golf clubs. For example, for cavity-back golf club iron heads that have relatively thin front faces, vibration and sound damping is desirable to improve the "feel" of the club when the club head impacts the ball.

When placed behind the front striking face of the golf club head for damping purposes, conventional badges damp sounds made from the face of the club vibrating after impact by constraining a layer of viscoelastic material (e.g., VHB Tape) disposed between a rear surface of the face and the badge. The face bends during vibration thereby shearing the VHB tape, which results in damping of the vibration. Generally, the more stiff the badge, the more efficient the viscoelastic layer located between the badge and the rear surface of the face, which improves the sound or feel of the golf club during impact. Stiffness refers to the rigidity of an object and is defined as Force divided by displacement. For purposes of discussion herein, we assume force is fixed. Thus, stiffness (S) can be expressed as a material's elasticity (E) times its area moment of inertia or $2^{nd}$ moment of area (I). In other words, $S=E\times I$. If we assume that a badge's elasticity remains constant throughout (i.e., the badge has the same material composition throughout) then the stiffness (S) of the badge becomes a function of the badge's area moment of inertia (I).

Although stiff badges are known in the art, such badges are too heavy, which adversely impacts the performance and feel of the club by adversely reducing the coefficient or restitution (COR) and/or increasing the height of the center of gravity (CG) of the club face, for example.

Other types of conventional vibration and sound dampers are typically affixed to the back surface of the face only at the face center (i.e., halfway between the heel and toe). One problem with such damping methods is that placement of the dampers behind the club center face decreases performance of the club head and provides little stiffening to a topline of the club head.

SUMMARY OF THE INVENTION

The invention addresses the above and other needs by providing various light-weight structures for damping the sound made when a golf club fact impacts a golf ball.

In accordance with some embodiments, sound damping is achieved by placing one or more structural members behind the front face of a golf club. The one or more structural members provide added stiffness and, in some embodiments, dampers located between the one or more structural members and a rear wall or backbar of the club head can be activated by the one or more structural members in direct shear normal to the face. The invention also improves current damping systems by allowing the engineer to target the location of the needed stiffness and damping by moving the structural members. The structural members may also provide stiffening to reduce movement of a topline portion of the club head during vibration and therefore further reduce sound.

In some embodiments, the structural member or set of members allows for stiffening and damping modes by moving the member(s) to the antinode, or location of maximum deflection, of the face or topline vibration. As used herein, "antinode" refers to one or more locations of maximum deflection of the face portion of the club head during vibration caused by the face impacting a golf ball. In some embodiments, the structural member or set of members allows for stiffening and damping modes by placing the member(s) directly behind the location(s) of maximum deflection of the face during vibration.

In further embodiments, the structural member(s) may be integrated into a badge which allows the badge to attach to other areas of the club (e.g., topline, backbar, etc.). Such attachment points may serve as damper locations by which to improve the sound of the club head, in accordance with various embodiments. The structural members also increase the area moment of inertia locally on the badge which creates dramatically increased stiffness. The interface between the structural members and other portions of the club head may include damping VHB tape or other damper materials. The structural members may also be moved left or right across the face during design and manufacturer to achieve desired damping and/or performance characteristics. None of these features are currently achievable using current badging systems which are affixed solely to the surface behind the face. The ability to target face and/or topline vibrations using the added stiffness and damping from the structural members is advantageous over conventional badge technologies.

In another embodiment, a golf club head includes: a face portion surrounded by a topline portion, a toe portion, a sole portion and a heel portion, the face portion having a front striking surface and a back surface; and a badge coupled to the back surface of the face portion, the badge including a planar main body portion and at least one structural member extending outwardly from the main body portion, wherein the at least one structural member includes a lower portion and an upper portion disposed between the topline portion and lower portion, and wherein the at least one structural member has a maximum height, above the main body portion, at the lower portion and a minimum height at the upper portion.

In a further embodiment, the invention provides a golf club head that includes: a face portion surrounded by a topline portion, a toe portion, a sole portion and a heel portion, the face portion comprising a front striking surface and a back surface; a back bar portion extending upwardly from the sole portion behind the face portion; and a rear cavity located behind the face portion and defined by inner peripheral walls of the topline portion, the toe portion, the sole portion and the heel portion. The golf club head further includes a badge coupled to the back surface of the face portion and disposed within an upper portion of the rear cavity above the back bar portion, wherein the badge includes: a planar main body portion; a first structural member located adjacent the toe portion and extending outwardly from the main body portion away from the face portion; and a second structural member located adjacent the heel portion and extending outwardly from the main body portion away from the face portion, wherein the first and second structural members are oriented substantially in a "V" configuration with respect to one another when the sole portion of the golf club head is grounded.

In yet another embodiment, the invention provides a badge configured to be inserted into a rear cavity of golf club head, the badge including: a planar main body portion; a first structural member extending outwardly from the main body portion; and a second structural member extending outwardly from the main body portion, wherein the first and second structural members are oriented substantially in a "V" configuration with respect to one another when inserted into the rear cavity of the golf club head and a sole portion of the golf club head is grounded.

The above exemplary features and other features of the invention will become apparent after reading the Detailed Description of Exemplary Embodiments with reference to the figures listed below.

BRIEF DESCRIPTION OF THE DRAWINGS

FIG. 10 illustrates a table showing area moment of inertia (I) measurements for various lofts of irons having the badge of FIG. 7A at various x and y coordinates shown in the grid of FIG. 10, in accordance with various embodiments of the invention.

DETAILED DESCRIPTION OF EXEMPLARY EMBODIMENTS

Figure 1A:
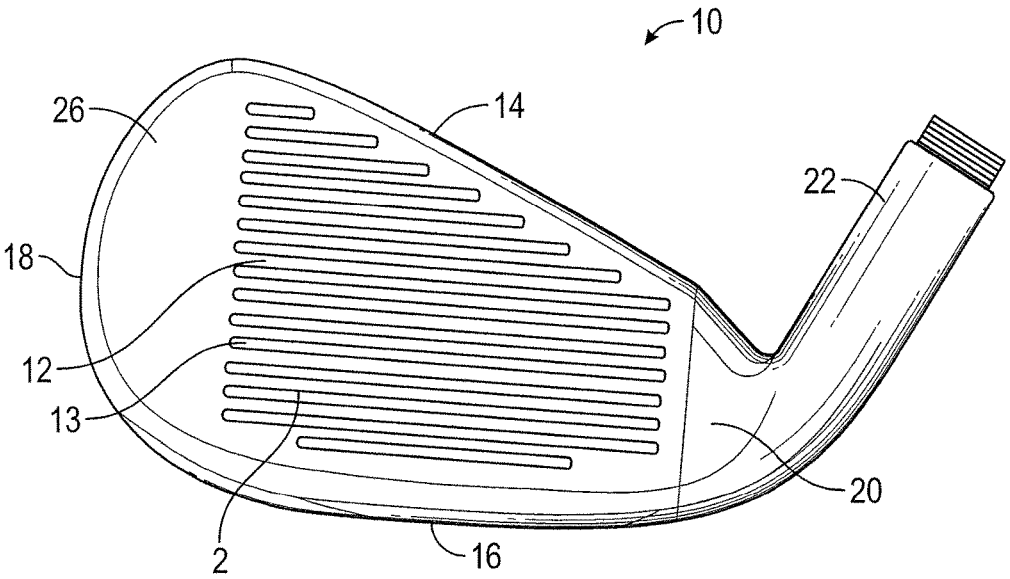
FIG. 1A is a perspective front view of an exemplary iron-type golf club head in which various embodiments of the present invention can be implemented.

Various exemplary embodiments of the invention are described in detail below with reference to the figures, wherein like reference numerals reference like elements throughout. The present disclosure describes exemplary embodiments of structural members and badges provided in a golf club head to dampen vibrations and sounds created when the club head impacts a golf ball. Although the structural members and badges are described herein as installed in the rear cavity of cavity-back iron-type club heads, in accordance with various exemplary embodiments, the structural members and badges can be installed in a cavity formed in another portion of the club head (such as the front, heel, toe, upper, and/or lower portions of the club head) or in another type of club head (such as a driver or wood-type club head, a putter or wedge, for example).

The description of the exemplary embodiments herein is intended to be read in connection with the accompanying drawings, which are to be considered part of the entire written description. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise Referring first to FIGS. 1A and 1B, there is shown an iron-type golf club head 10, according to one embodiment. The club head 10 comprises a front main body 2 having a face portion 12 surrounded by respective front portions of the upper topline portion 14, a lower or sole portion 16, a toe portion 18, and a heel portion 20. The face portion 12 includes a front surface 26 and a back surface 28, which define a thickness of the face portion 12. A plurality of horizontal grooves 13 are formed in the front surface 26 of the face portion 12, which help provide "back spin" to a golf ball that is struck by the front surface 26. When the sole portion 16 of the club head 10 is grounded (i.e., the sole touches the ground) during a normal address position before a golf ball is struck, these grooves 13 are typically substantially horizontal and parallel with the surface of the ground (i.e., ground plane).

Figure 1B:
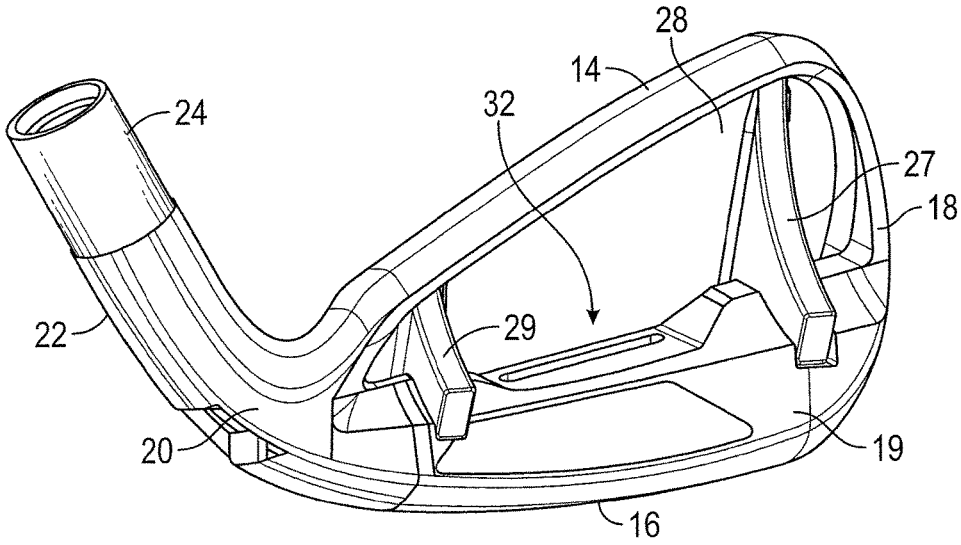
FIG. 1B is a perspective rear view of the iron-type golf club of FIG. 1A having two structural members installed at predetermined locations in the rear, cavity portion of the club head, in accordance with one embodiment of the invention

As shown in FIG. 1B, the club head 10 is a "cavity back" type club head that comprises a rear cavity 32 that extends upwardly from the sole portion 16 between the toe portion 18 and the heel portion 20. A rear wall or backbar 19 covers a lower part of the cavity 32 behind the face portion 12. The club head also includes a hosel 22 extending from the area where the heel portion 20 joins the main body portion 2. A shaft 24 can be joined to the hosel 22 to form an assembled golf club. The lower end portion of the shaft 24 extends into the hosel 22 and is secured in place using conventional techniques or mechanisms.

Figure 2:
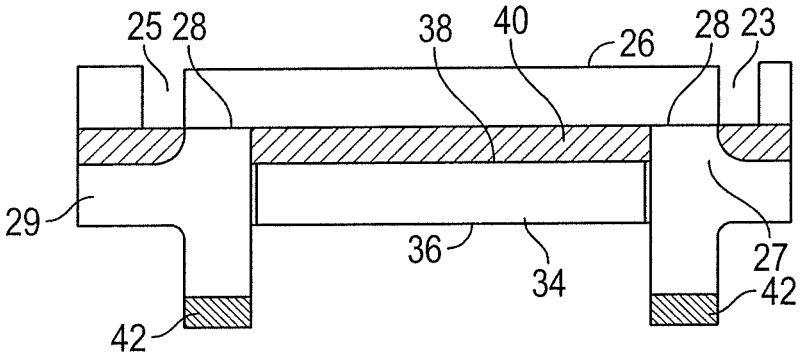
FIG. 2 is a cross-sectional top view showing the two structural members attached at predetermined locations in the rear, cavity portion of the club head of FIG. 1B, in accordance with one embodiment.

Optionally the club head may also include slots or channels situated at various points as further described in copending U.S. application Ser. No. 14/145,761 filed on Dec. 23, 2013 in the name of Taylor Made Golf Co. Inc., the entire contents of which are incorporated herein by reference. As shown in FIG. 2, in some embodiments, the club head 10 may include a first channel or "toe side channel" 23 proximate the toe portion 18, a second channel or "heel side channel" 25 proximate the heel portion 20, both of which are defined through the striking face of the golf club head and described in further detail with reference to FIGS. 30A-31C, for example, of U.S. application Ser. No. 14/145,761. In some embodiments the club head 10 may also have a "sole channel," which provides a passage through the sole and into a rear void (e.g., a recess or internal cavity) of the club head, as illustrated in FIG. 31C, for example, and described in connection therewith in U.S. application Ser. No. 14/145,761.

Referring again to FIG. 1B, the cavity 32 opens rearwardly above the rear wall 19 (a.k.a., "backbar 19") and is defined by internal surfaces of the toe portion 18, the heel portion 20, sole portion 16, topline portion 14 and face portion 12. Attached in recesses in the rear wall 19 and projecting connecting to the rear surface 28 of the face portion 12 are two structural members, a toe side structural member 27, situated on the toe side of the rear wall 19 and a heel side structural member 29, situated on the heel side of the rear wall 19. As shown in FIG. 2, the toe side structural member 27 extends upwardly from the rear wall 19 and contacts the rear surface 28 of the face portion 12 inward and adjacent to the toe side channel 23 proximate the toe portion 18. In one embodiment, the toe side structural member 27 abuts directly against the rear surface 28 without any other material (e.g., double-sided tape, glue, etc.) located therebetween such that any movement of the face 12 is translated directly to the structural member 27.

Similarly, the heel side structural member 29 extends upwardly from the rear wall 19 and contacts the rear surface 28 of the face portion 12 inward and adjacent to the heel side channel 25 proximate the heel portion 20. In one embodiment, the heel side structural member 29 abuts directly against the rear surface 28 without any other material (e.g., double-sided tape, glue, etc.) located therebetween such that any movement of the face 12 is translated directly to the structural member 29. In some embodiments, at the attachment point of the two structural members 27 and 29 to the rear wall 19, an additional damping effect may be obtained by abutting the rear portions of each structural member to a damping material which can be in the form of tape or as a layer of rubber 42, in accordance with some embodiments. A preferred example of such a rubber includes the family of thermoplastic rubbers available in both hydrogenated and non-hydrogenated grades from Kuraray Rubber Co under the tradename HyBrar™. These rubbers exhibit high vibration damping properties at room temperature due to their chemical structure which consists of a triblock copolymer having both polystyrene blocks and polyisoprene blocks. Although FIG. 1B illustrates an embodiment having two vertically oriented structural members 27 and 29, in alternative embodiments, a golf club head can include only a single structural member that is disposed within a center or off-center location of the cavity 32.

The club head shown in FIG. 2 also includes a badge 34 disposed inside the cavity 32, in accordance with some embodiments. The badge 34 has an exposed outer surface 36 that is visible to a user. Words, logos, designs, graphics, trademarks and other types of visible indicia may be printed or formed on the outer surface 36 for aesthetic or decorative purposes. As shown in FIG. 2, a front or inner surface 38 of the insert can be adhesively secured to the rear surface 28 of the face portion 12 within the cavity 32, such as with a layer of double-sided tape 40, to ensure that insert remains in place within the cavity during normal use of the golf club. Alternatively, the badge 34 can be secured to the rear surface 28 with epoxy or another suitable adhesive or glue.

In some embodiments, the badge 34 may also comprise materials or be constructed in a manner to provide a performance benefit, such as vibration damping. Any of various suitable materials can be used to form the badge 34. For example, in some embodiments, the badge 34 may comprise a metal (e.g., aluminum, steel, nickel, cobalt, titanium, or alloys including these materials) and/or one or more of various polymers (e.g., ABS (acrylonitrile-butadiene-styrene) plastic, nylon, and/or polycarbonate), and/or an elastomer or a viscoelastic material, such as rubber or any of various synthetic elastomers, such as polyurethane, a thermoplastic or thermoset material polymer, or silicone, or any combination of these materials.

In other embodiments, the structural members 27 and 29 can be combined in a unitary construction with the badge or medallion. In the embodiment shown in FIG. 3, the two structural members 27 and 29 are integrally formed with the badge as a one piece unitary badge 44 that is disposed inside the cavity 32. Similar to the structural members 27 and 29 illustrated in FIG. 1B, in one embodiment, the two structural members 27 and 29 extend rearwardly from the badge 44 and attach in recesses in the rear wall 19. From the rear wall 19, the structural members 27 and 29 project upwardly in a substantially vertical direction and tapers to a smaller height above a rear surface of the badge 44 as they approach a top portion of the badge 44. This tapering is best illustrated in FIG. 2. In alternative embodiments, the structural members 27 and 29 are not integrally formed with the badge but may be separate structures that are affixed to a surface of the badge or otherwise assembled with other portions of the badge using various known techniques (e.g., gluing, bonding, etc.)

Figure 3:
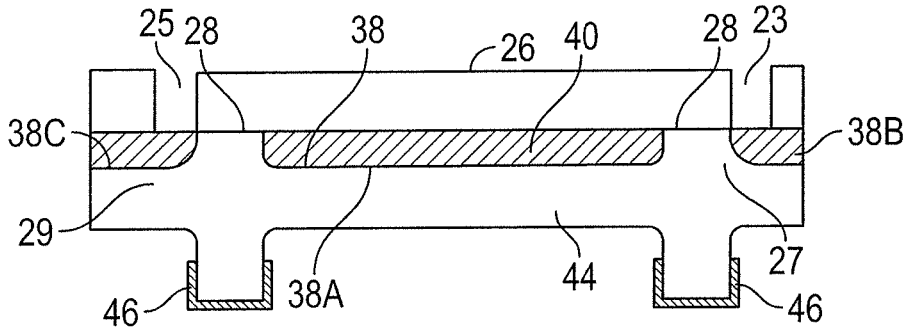
FIG. 3 is a cross-sectional top view showing a badge having two vertically oriented structural members attached in the rear, cavity portion of the club head of FIG. 1B, in accordance with one embodiment of the invention.

As shown in FIG. 3, in one embodiment, the toe side structural member 27 extends beyond a front surface of the badge 44 and directly contacts the rear surface 28 of the face portion 12 inward and adjacent to the toe side channel 23 proximate the toe portion 18, such that any movement of the face portion 12 is directly translated to the structural member 27. Similarly, the heel side structural member 29 extends beyond a front surface of the badge 44 and directly contacts the rear surface 28 of the face portion 26 inward and adjacent to the heel side channel 25 proximate the heel portion 20, such that any movement of the face portion 12 is directly translated to the structural member 27. As discussed above, in some embodiments, the attachment point of the two structural members 27 and 29 to the rear wall 19 allows an additional damping effect to be obtained by abutting the rear portions of each structural member to a damping material which can be in the form of tape 46 or a layer of rubber, for example.

Referring again to FIG. 3, an inner surface 38 of the badge 44 can be adhesively secured to the rear surface 28 of the face portion 12 within the cavity 32, such as with a layer of double-sided tape 40, to ensure that the badge 44 remains in place within the cavity during normal use of the golf club. Alternatively, the badge 44 can be secured to the rear surface 28 with epoxy or another suitable adhesive or glue. As shown in FIG. 3, a central front surface 38A of the badge 44 attaches to the central portion of the rear surface 28 between the heel side channel 25 and the toe side channel 23. Additionally, a front toe-side surface 38B of the badge 44 proximate the toe portion 18 attaches to the rear surface 28 proximate to the toe portion 18 of the club head 2. Similarly, a front heel-side surface 38C of the badge 44 attaches to the rear surface 28 proximate the heel portion 20. Each of the aforementioned attachments can be accomplished using any known technique, including double-sided tape, epoxy, etc.

Figure 4A:
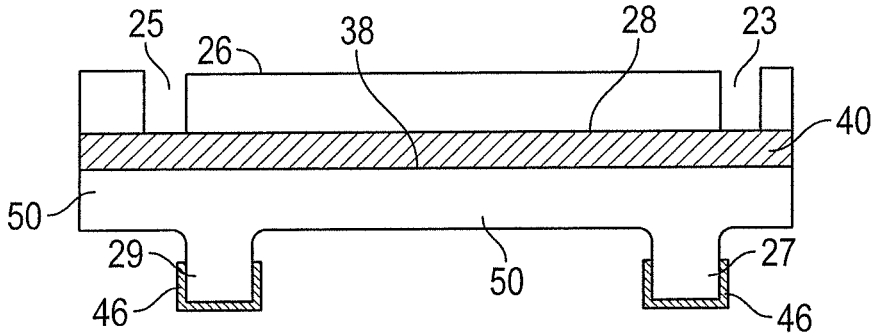
FIG. 4A is a cross-sectional top view showing a badge having two vertically oriented structural members attached in the rear, cavity portion of the club head of FIG. 1B, in accordance with another embodiment of the invention.

FIG. 4A illustrates a cross-sectional top view of a badge 50 attached to a rear surface 28 of a face portion 12, in accordance with another embodiment of the invention. As shown in FIG. 4, badge 50 is similar to the badge 44 of FIG. 3, except that the structural members 27 and 29 do not extend beyond the front surface 38 of the badge 50 to directly contact the rear surface 28 of the face portion 12. The toe side structural member 27, and heel side structural member 29 are again integrally formed with the badge 50, which is configured to be attached to and disposed inside the cavity 32 of the iron club head 2. In one embodiment, the front or inner surface 38 of the badge 50 is adhesively secured to the rear surface 28 of the face portion 12 within the cavity 32 with a layer of double-sided tape 40, to ensure that the badge 50 remains in place within the cavity during normal use of the golf club. Alternatively, the badge 50 can be secured to the rear surface 28 with epoxy or another suitable adhesive or glue. In some embodiments, the badge 50 may comprise materials or be constructed in a manner to provide a performance benefit, such as vibration damping. In the embodiment shown in FIG. 4A the inner surface 38 of the badge 50 extends beyond the toe side channel 23 and the heel side channel 25 and attaches to the rear surface 28 of the face portion 12.

Similar to previously described embodiments, at the attachment point of the two structural members 27 and 29 to the rear wall 19, an additional damping effect may be obtained by abutting the rear portions of each structural member 27 and 29 to a damping material 46 which can be in the form of tape or as a layer of rubber disposed between each structural member 27 and 29 and the rear wall 19 of the cavity 32. Additionally, any of various suitable materials can be used to form the badge 50. For example, in some embodiments, the badge 50 may comprise a metal (e.g., aluminum, steel, nickel, cobalt, titanium, or alloys including these materials) and/or one or more of various polymers (e.g., ABS (acrylonitrile-butadiene-styrene) plastic, nylon, and/or polycarbonate), and/or an elastomer or a viscoelastic material, such as rubber or any of various synthetic elastomers, such as polyurethane, a thermoplastic or thermoset material polymer, or silicone, or any combination of these materials. In some embodiments, the structural members 27 and 29 are integrally formed with the remaining portions of the badge 50 and made from one common material. In alternative embodiments, the structural members 27 and 29 may be made from a different material than the remaining portions of the badge 50 and attached using any suitable, known technique.

Figure 4B:
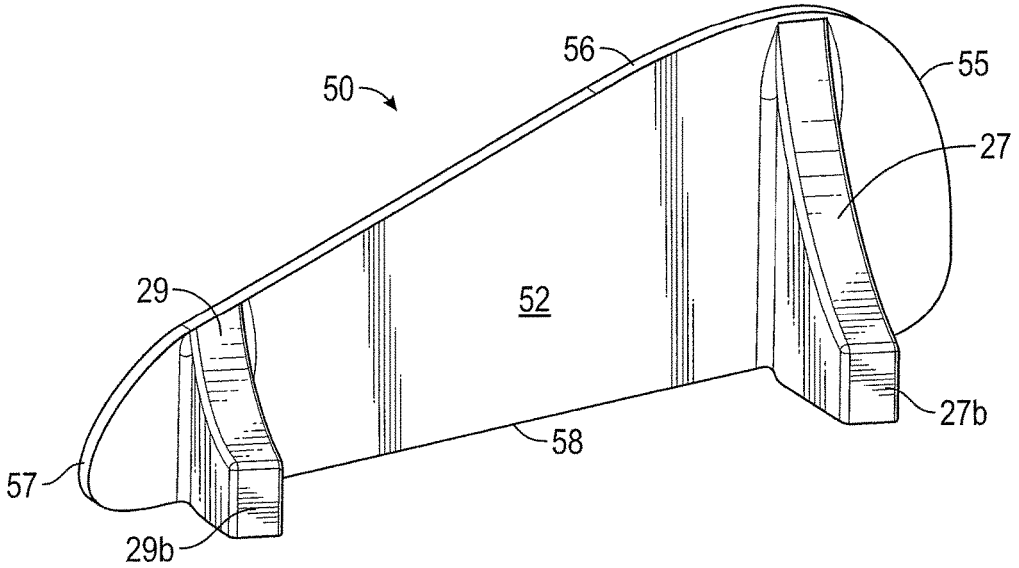
FIG. 4B is a perspective view of the badge of FIG. 4A, in accordance with one embodiment of the invention.

FIG. 4B illustrates a perspective view of the badge 50, in accordance with one embodiment. The badge 50 includes a main body 52 having a front surface (not shown) and a back surface from which the toe-side structural member 27 and heel side structural member 29 extend outwardly, as shown. In some embodiments, the toe-side structural member 27 is positioned on the main body 52 so that it is oriented substantially vertically when the face portion 12 impacts a golf ball (or when the sole is resting on the ground during a normal address position) and directly behind a first antinode of the face portion 12. Similarly, the heel-side structural member 29 is positioned on the main body 52 so that it is oriented substantially vertically when the face portion 12 impacts a golf ball (or when the sole is resting on the ground during a normal address position) and directly behind a second antinode of the face portion 12.

As shown in FIG. 4B, the toe-side structural member 27 has a maximum height above the main body 52 at a lower portion of the structural member 27 that includes a first rear flat surface 27*b* to which a damping material 46 may be affixed to provide further damping to the golf club head 12 after impacting a golf ball. The height of the toe-side structural member 27 gradually decreases in a tapered fashion toward an upper portion of the structural member 27 located adjacent a topline peripheral edge 56 of the main body 52. Similarly, the heel-side structural member 29 has a maximum height above the main body 52 at a lower portion of the structural member 29 that includes a second rear flat surface 29*b* to which a damping material 46 may be affixed. The height of the heel-side structural member 29 gradually decreases in a tapered fashion toward an upper portion of the structural member 27 located adjacent the topline peripheral edge 56 of the main body 52.

As discussed above, the damping material 46 provides an additional viscoelastic layer of material between the structural members 27 and 29 and an inner surface of the rear wall 19 to further reduce vibrations, and hence sound, caused by the club head 12 impacting a golf ball. The main body 52 includes a toe-side peripheral edge 55 that is sized and shaped to conform to a corresponding toe side internal peripheral edge of the cavity 32, the topline peripheral edge 56 that is sized and shaped to conform to an internal topline internal peripheral edge of the cavity, a heel side peripheral edge 57 that is sized and shaped to conform to a corresponding heel side internal peripheral edge of the cavity 32, and a bottom peripheral edge 58 that is sized and shaped to extend partially into the lower portion of the cavity 32 located between the face portion 12 and rear wall 19, as described above.

Figure 5:
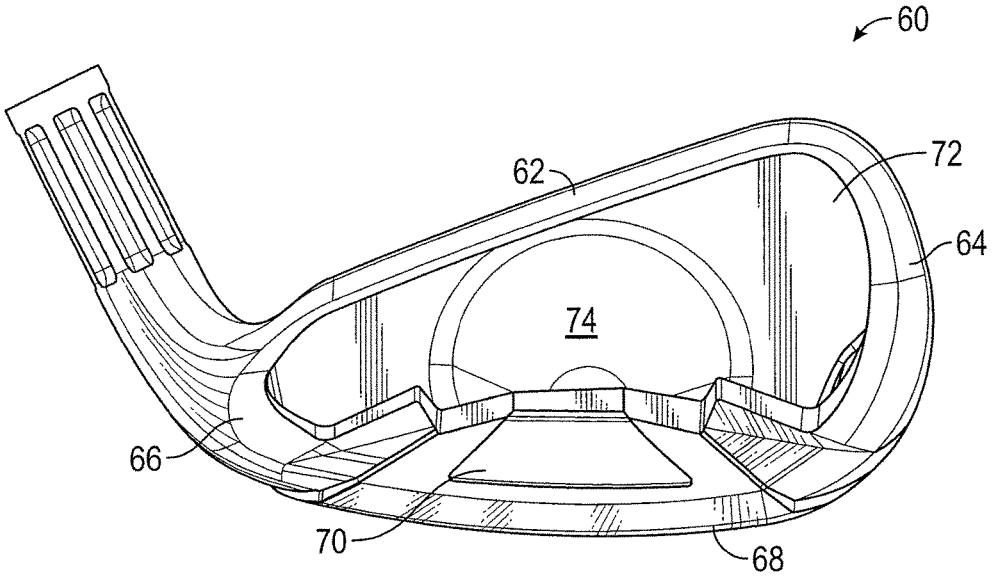
FIG. 5 is a perspective rear view of a golf club iron head without a badge installed in the rear, cavity portion of the club head, in accordance with one embodiment of the invention.

FIG. 5 illustrates a perspective rear view of a cavity-back type golf iron club head 60, in accordance with one embodiment of the invention. A perspective front view of the club head 60 can be similar to that shown in FIG. 1A, for example. The iron head 60 includes a topline portion 62, a toe portion 64, a heel portion 66, a sole portion 68 and a rear wall 70 extending upwardly from the sole portion 68. A rear cavity 72 is defined by inner peripheral surfaces of the topline, toe, heel and sole portions 62, 64, 66 and 68, respectively. The rear wall 70 covers a lower portion of the cavity 72, which is disposed between a rear surface 74 of the face portion 12 of the club head 60 and an inner surface of the rear wall 70.

Figure 6:
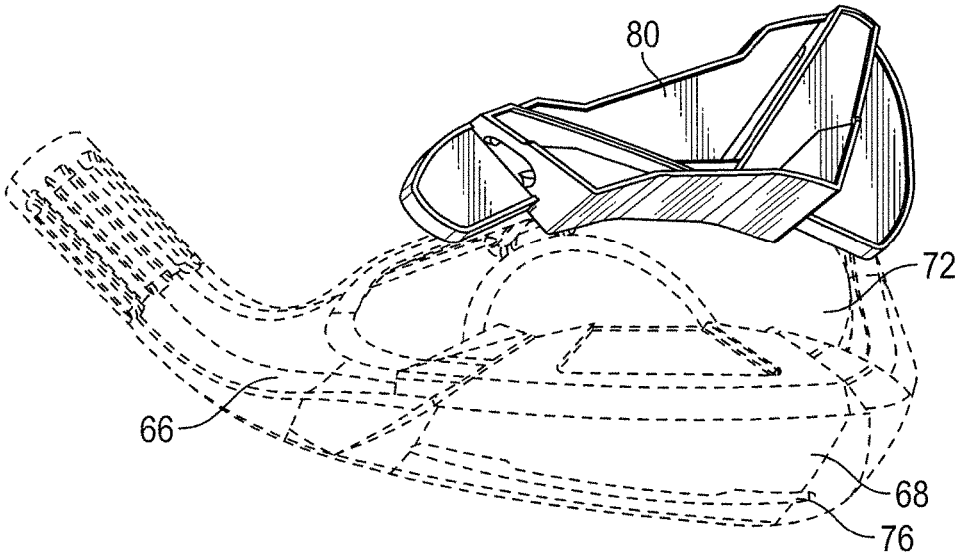
FIG. 6 is a perspective, exploded view of the club head of FIG. 5 with a badge before installation into a rear cavity of the club head, in accordance with one embodiment of the invention.

FIG. 6 illustrates a perspective, exploded view of the iron club head 60 of FIG. 5 and a badge 80 configured to be inserted into the cavity 72 of the club head 60. In FIG. 6, the outline of the club head 60 is provided in dashed lines to distinguish and highlight the features of the badge 80 more clearly. In one embodiment, sole portion 68 includes a sole channel or slot 74, which provides a passage through the sole toward or into a rear void (e.g., a recess or internal cavity) of the club head 60. The sole channel 76 may be similar to the sole channel 3055 illustrated in FIG. 31C and described in connection therewith in U.S. application Ser. No. 14/145,761, which is incorporated by reference herein in its entirety. Various features of the badge 80 are described in further detail below with reference to FIGS. 7A-7F.

Figure 7A:
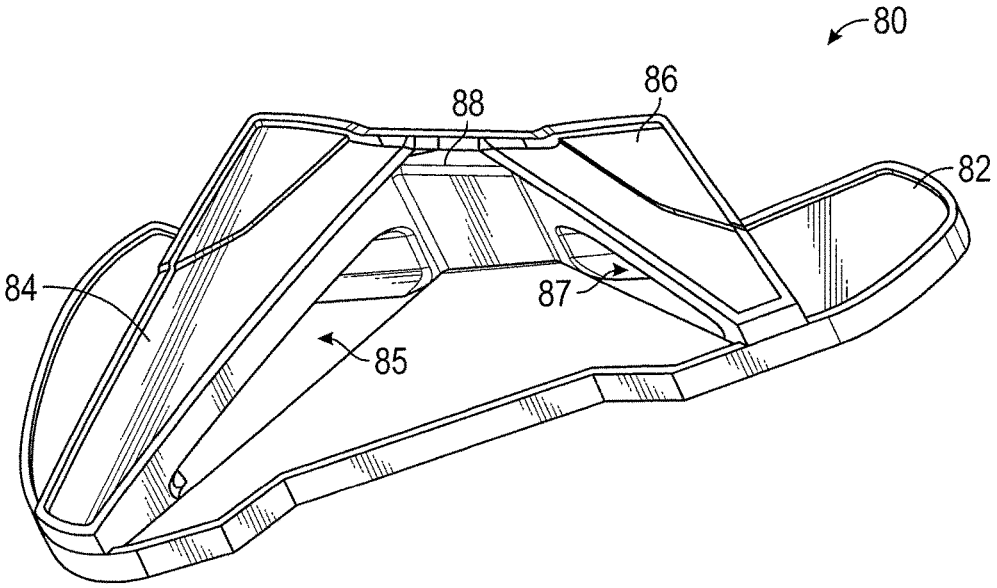
FIG. 7A is a three-dimensional top view of the badge, in accordance with one embodiment of the invention.

FIG. 7A is a three-dimensional, angled top view of the badge 80, in accordance with one embodiment. The badge 80 includes a main body portion 82 having a perimeter shape configured to fit within an upper portion of the cavity 72 of the club head 60. Extending upwardly from the main body portion 82 is a first structural member 84 and a second structural member 86, in accordance in one embodiment. In the illustration shown in FIG. 7A, the first and second structural members 84 and 86 form an upside-down "V" configuration and each structural member 84 and 86 increases in height and width from a top of the "V" to the bottom of the "V" where structural members 84 and 86 are connected by a horizontal bridge structure 88. In one embodiment, the first structural member 84 may include a first cut-out portion 85 and the second structural member 86 may include a second cut-out portion 87, which reduce the overall weight of the badge 80.

Figure 7B:
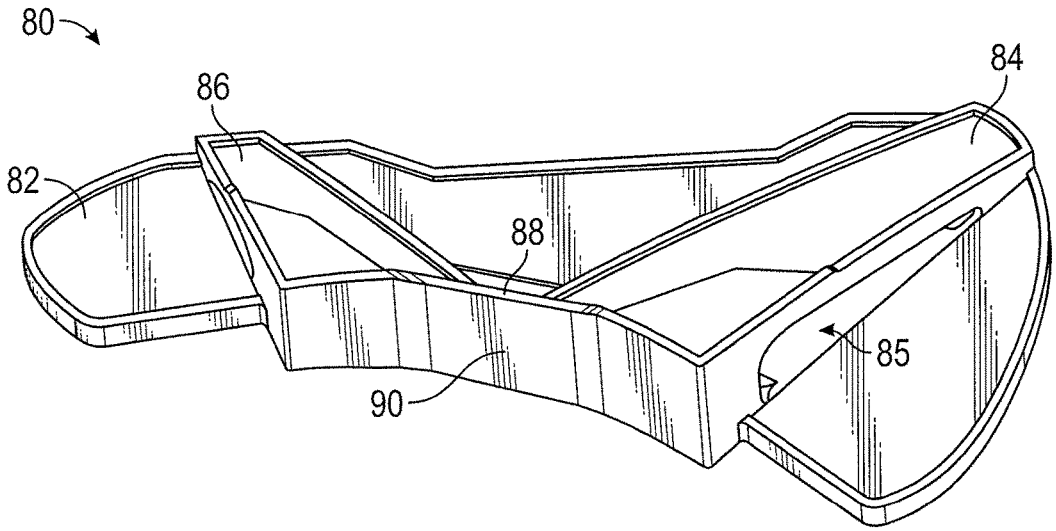
FIG. 7B is a three-dimensional bottom view of the badge of FIG. 7A, in accordance with one embodiment of the invention.

FIG. 7B illustrates a three-dimensional, angled bottom view of the badge 80, in accordance with one embodiment. In addition to the structures and features discussed above with respect to FIG. 7A, FIG. 7B further illustrates a segmented bottom wall 90 that is configured to contact and mate with a top surface of the rear wall 70, as shown in FIG. 5.

Figure 7C:
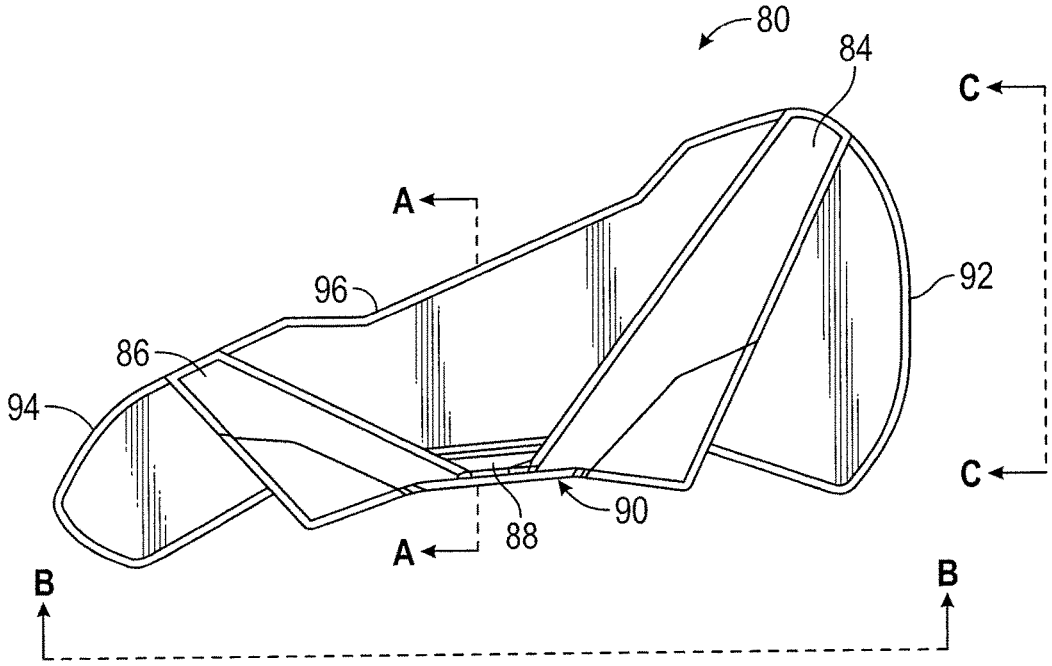
FIG. 7C is a perspective top view of the badge of FIG. 7A, in accordance with one embodiment of the invention.

FIG. 7C illustrates a top view of the badge 80, in accordance with one embodiment. In this view, one can clearly see that the width of first structural member 84 is narrowest at the top of the first structural member 84 (i.e., at the top of the "V" configuration) and gradually increases toward the bottom of the first structural member 84, where it joins the horizontal bridge structure 88. Similarly, the width of the second structural member 86 is narrowest at the top of the second structural member 86 (i.e., at the top of the "V" configuration) and gradually increases toward the bottom of the second structural member 84, where it joins the horizontal bridge structure 88, which bridges and joins the bottom portions of the first and second structural members 84 and 86 together.

As further shown in FIG. 7C, the main body 82 of the badge 80 includes a toe-side perimeter 92 that is sized and shaped to conform with an inner perimeter surface of the cavity 72 at the toe portion 64 of the club head 60. Similarly, a heel-side perimeter 94 of the main body 82 is sized and shaped to conform with an inner perimeter surface of the cavity 72 at the heel portion 66 of the club head 60, and a top perimeter 96 is sized and shaped to conform with an inner perimeter surface of the cavity 72 at a top-line portion 62 of the club head 60. As discussed above, the bottom perimeter wall 90 of the badge 80 is sized and shaped to conform with an inner, top surface of the rear wall 70 that covers a lower region of the cavity 72 immediately above the sole portion 68 of the club head 60.

Figure 7D:
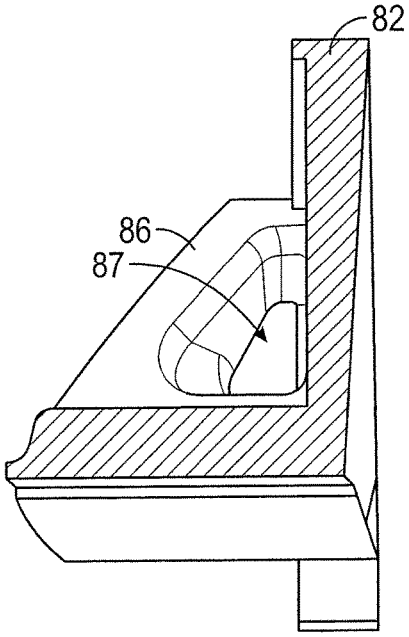
FIG. 7D is a cross-sectional view of the badge of FIG. 7A taken along line A-A of FIG. 7C, in accordance with one embodiment of the invention.
Figure 7E:
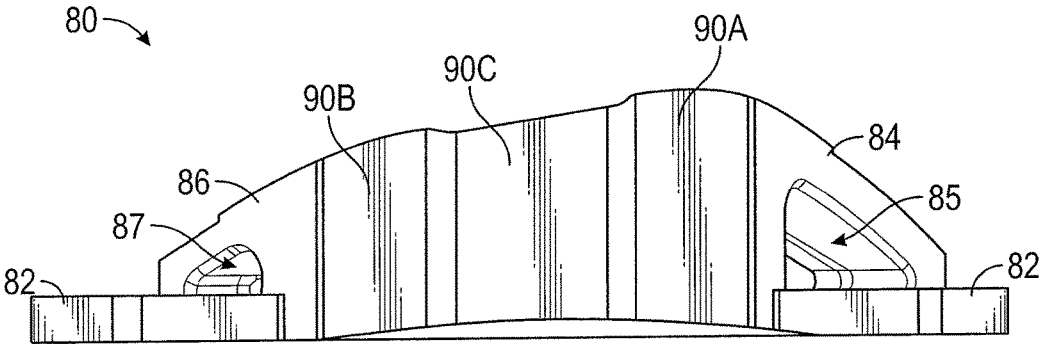
FIG. 7E is a perspective sole side view of the badge of FIG. 7A taken along line B-B of FIG. 7C, in accordance with one embodiment of the invention.
Figure 7F:
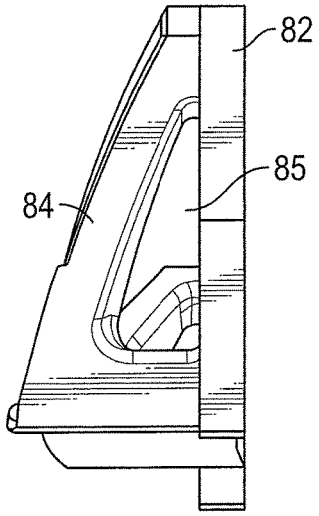
FIG. 7F is a perspective toe side view of the badge of FIG. 7A taken along line C-C of FIG. 7C, in accordance with one embodiment of the invention.

FIG. 7D illustrates a cross-sectional view of the badge 80 taken along lines A-A of FIG. 7C, in accordance with one embodiment, FIG. 7E show a bottom side view of the badge taken along lines B-B of FIG. 7C, in accordance with one embodiment and FIG. 7F shows a toe-side, side view of the badge 80 taken along lines C-C of FIG. 7C. As shown in these figures, the height and width of the first structural member 84 are greatest at the bottom portion of the badge 80, where a bottom side wall 90A of the first structural member 84 makes up a first wall segment 90A of the bottom perimeter wall 90. The height and width of the first structural member 84 gradually decrease from the bottom portion of the badge 80 as it travels upwardly in a diagonal fashion to a top portion of the badge 80. The cut-out 85 of the first structural member 84 has a shape that largely mirrors the shape of the first structural member 84 (e.g., roughly a "pie" shape) and reduces the overall mass of the badge 80. In one embodiment, the first structural member 84 has a maximum height in the range of 7 to 20 mm, preferably 12 to 18 mm, a minimum height in the range of 2 to 8 mm, preferably 3 to 6 mm, a maximum width in the range of 8 to 20 mm, preferably 10 to 15 mm, a minimum width in the range of 3 to 10 mm, preferably 5 to 8 mm and a longitudinal length measured along a longitudinal centerline in the range of 20 to 40 mm, preferably 25 to 35 mm.

Similarly, the height and width of the second structural member 86 are greatest at the bottom portion of the badge 80, where a bottom side wall 90B of the second structural member 86 makes up a second wall segment 90B of the bottom perimeter wall 90. The height and width of the second structural member 86 gradually decrease from the bottom portion of the badge 80 as it travels upwardly in a diagonal fashion to a top portion of the badge 80. The cut-out 87 of the second structural member 86 has a shape that largely mirrors the shape of the second structural member 86 (e.g., roughly a "pie" shape) and reduces the overall mass of the badge 80. In one embodiment, the second structural member 86 has a maximum height in the range of 7 to 20 mm, preferably 12 to 18 mm, a minimum height in the range of 2 to 8 mm, preferably 3 to 6 mm, a maximum width in the range of 8 to 20 mm, preferably 10 to 15 mm, a minimum width in the range of 3 to 10 mm, preferably 5 to 8 mm and a longitudinal length measured along a longitudinal centerline in the range of 10 to 25 mm, preferably 15 to 20 mm.

The bridge structure 88 spans horizontally between and connects lower portions of the first and second structural members 84 and 86 and provides a third wall segment 90C of the bottom perimeter wall 90. Thus, the first, second and third wall segments 90A-90C together form the perimeter wall 90 of the badge 80. As further shown in FIGS. 7C-7F, the length and maximum height of the first structural member 84 are greater than the length and maximum height of the second structural member 86, respectively. The height of the bridge structure 88 gradually decreases as it travels from the first structural member 84 to the second structural member 86, thereby providing a relatively smooth transition from the maximum height of the first structural member 84 to the maximum height of second structural member 86. In one embodiment, the height of the bridge structure 88 is in the range of 10 to 15 mm, the width of the bridge structure 88 is in the range of 2 to 5 mm and the length of the bridge is in the range of 5 to 10 mm.

As shown in FIGS. 7A-7F, in some embodiments, all of the structures (e.g., main body 82, first and second structural members 84 and 86, bridge structure 88) of the badge 80 may be integrally formed as a single unitary structure made from the same material. In alternative embodiments, one or more of the structures of the badge 80 may be made from a different material than the remaining structures of the badge and affixed or secured (e.g., bonded, glued, screwed, etc.) to an appropriate location on the badge 80. The badge 80 may be made from any suitable material that provides a desired stiffness and mass to achieve one or more desired performance characteristics. For example, in some embodiments, the badge 80 may comprise a metal (e.g., aluminum, steel, nickel, cobalt, titanium, or alloys including these materials) and/or one or more of various polymers (e.g., ABS (acrylonitrile-butadiene-styrene) plastic, nylon, and/or polycarbonate), and/or an elastomer or a viscoelastic material, such as rubber or any of various synthetic elastomers, such as polyurethane, a thermoplastic or thermoset material polymer, or silicone, or any combination of these materials. Additionally, in alternative embodiments the first and second structural members 84 and 86 may be oriented in alternative configurations such as substantially vertically, or a "V" configuration instead of an upside-down "V" configuration as shown in FIGS. 7A-7F.

Figure 8A:
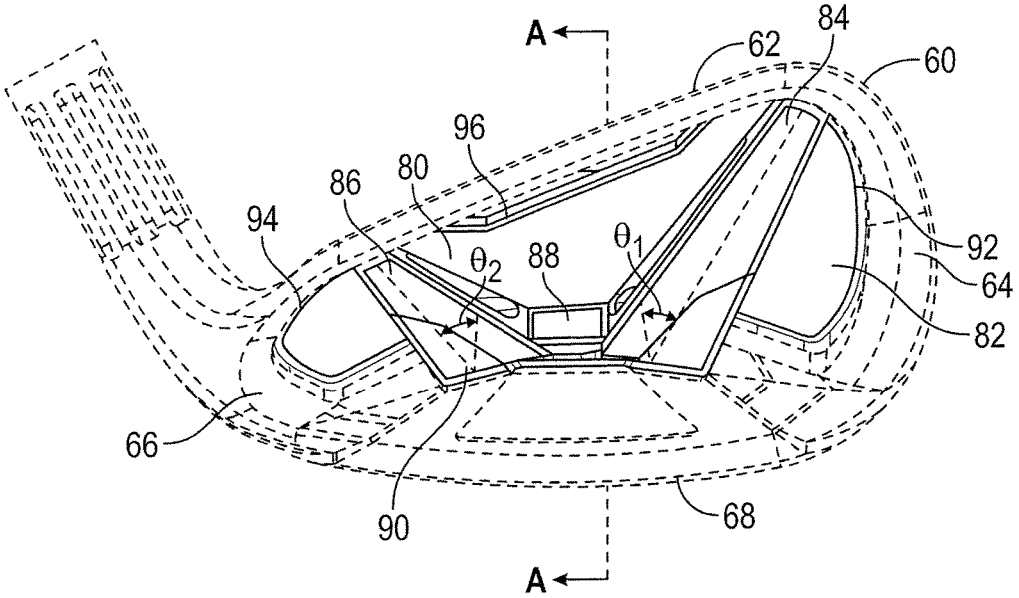
FIG. 8A is a perspective, rear view of the club head of FIG. 5 with the badge of FIG. 7A installed into the rear cavity of the club head, in accordance with one embodiment of the invention.
Figure 8B:
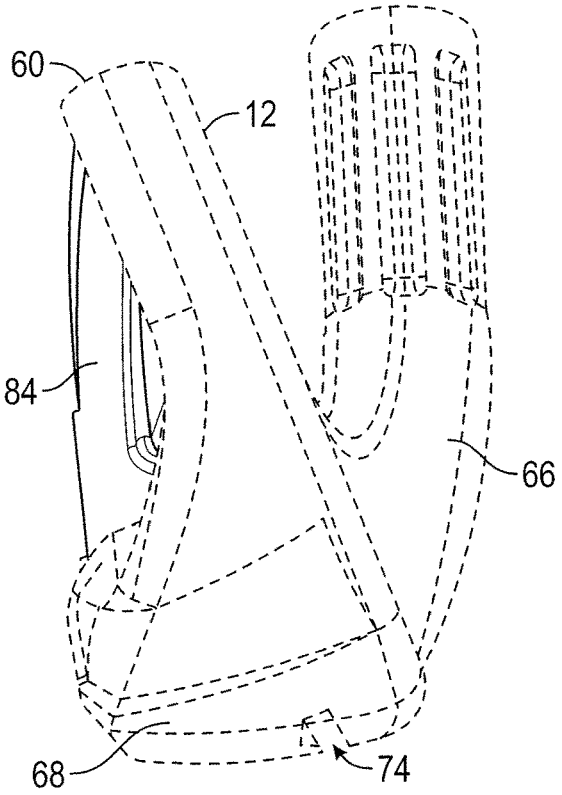
FIG. 8B is a perspective, toe-side view of the club head of FIG. 8A, in accordance with one embodiment of the invention.
Figure 8C:
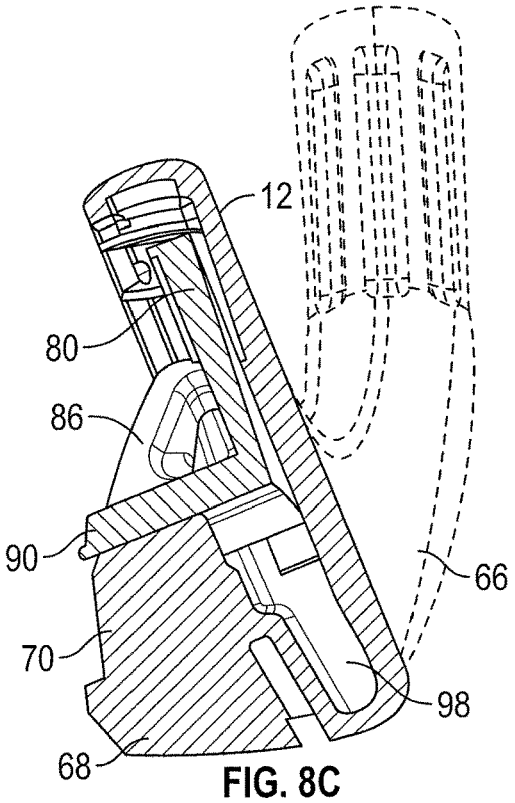
FIG. 8C is a cross-sectional view of the club head of FIG. 8A taken along line A-A of FIG. 8A, in accordance with one embodiment of the invention.

FIG. 8A illustrates a perspective rear view of a golf iron club head 60 having a badge 80 installed in a rear cavity of the club head 60, in accordance with one embodiment of the invention. FIG. 8B illustrates a perspective toe-side view of the golf iron club head 60. FIG. 8C illustrates a cross-sectional view taken along lines A-A of FIG. 8A. In these figures, the outline of the club head 60 is provided in dashed lines to distinguish and highlight the features of the badge 80 more clearly. As shown in these figures, the badge 80 is form fit into an upper portion of the cavity 72 (FIG. 6) of the club head 60 such that a toe peripheral edge 92 is sized and shaped to conform to an inner surface of the toe portion 64 of the club head 60, a heel peripheral edge 94 is sized and shaped to conform to an inner surface of the heel portion 66 of the club head, a top peripheral edge 96 is sized and shaped to conform to an inner surface of the topline portion 62 of the club head 60, and the bottom wall 90 of the badge 80 is sized and shaped to conform to an inner, tope surface of the rear wall 70 (FIG. 5) extending upwardly from the sole portion 64 of the club head 60.

As shown in FIG. 8A, the first and second structural members 84 and 86 extend upwardly from the bottom wall 90, away from the sole portion 68, in a diagonal "V" shape configuration. The bridge structure 88 spans between and joins the bottom portions of the first and second structural members 84 and 86. As shown in the cross-sectional view of FIG. 8C, in accordance with some embodiments, the club head 60 includes a lower cavity portion 98 located between the face portion/striking plate 12 and the rear wall 70. This lower cavity portion 98 is not occupied by any structures or any portions of the badge 80, thereby reducing the overall mass of the club head 60 with badge 80. Generally, in accordance with various embodiments, the badge 80 will have a mass of less than 15.0 grams. In other embodiments, the badge 80 can have a mass of less than 12.0 grams. In further embodiments, the badge 80 can have a mass of less than 10.0 grams.

In some embodiments, the overall size, shape and/or mass of the badge 80 may be adjusted depending on the size and/or shape of the iron club head. For example, in some embodiments, for long-range irons such as the "4" and "5" irons, the size of the badge is slightly smaller and has a mass of approximately 9.0 grams, while for mid-range irons such as "6" and "7" irons, the size of the badge is slightly larger and has a mass of approximately 10.1 grams, while for short-range irons such as "8," "9" and pitching wedge (PW)

irons, the size of the badge is the largest and has a mass of approximately 11.6 grams. Each of the above mass values has a tolerance of ±0.5 grams. Additionally, in some embodiments, a maximum thickness of the face portion (i.e., striking plate) of the long-range and mid-range irons (e.g., 4-7 irons) is 3.1 millimeters (mm), the maximum thickness of the face portion of the 8 irons is 2.8 mm, the maximum thickness of the face portion of the 9 iron is 3.2 mm, and the maximum thickness of the face portion of the PW iron is 3.6, each of the above thickness values having a tolerance of ±0.15 mm. It has been found that the above combination of badge masses and corresponding iron face plate thickness provides a desired level of vibration/sound damping while remaining within USGA COR requirements. In some embodiments, an iron-type club head 60 having a badge 80 inserted therein will have a COR value within 0.035 points of the USGA calibration plate used for testing the club head.

As described more fully in U.S. Pat. No. 8,920,261 issued on Dec. 30, 2014 in the name of Taylor Made Golf Co. Inc., the entire contents of which are incorporated by reference herein, in some embodiments, any one of the badges 34, 44, 50 and 80 described above can further comprise a central portion and a deflectable portion coupled to and extending along a peripheral edge section of the central portion. The deflectable portion has a shape corresponding to and contacting a corresponding section of the inner peripheral surface of the cavity. The deflectable portion forms a press-fit engagement with the corresponding section of the inner peripheral surface of the cavity that retains the deflectable portion in a deflected state relative to the central portion.

Figure 9:
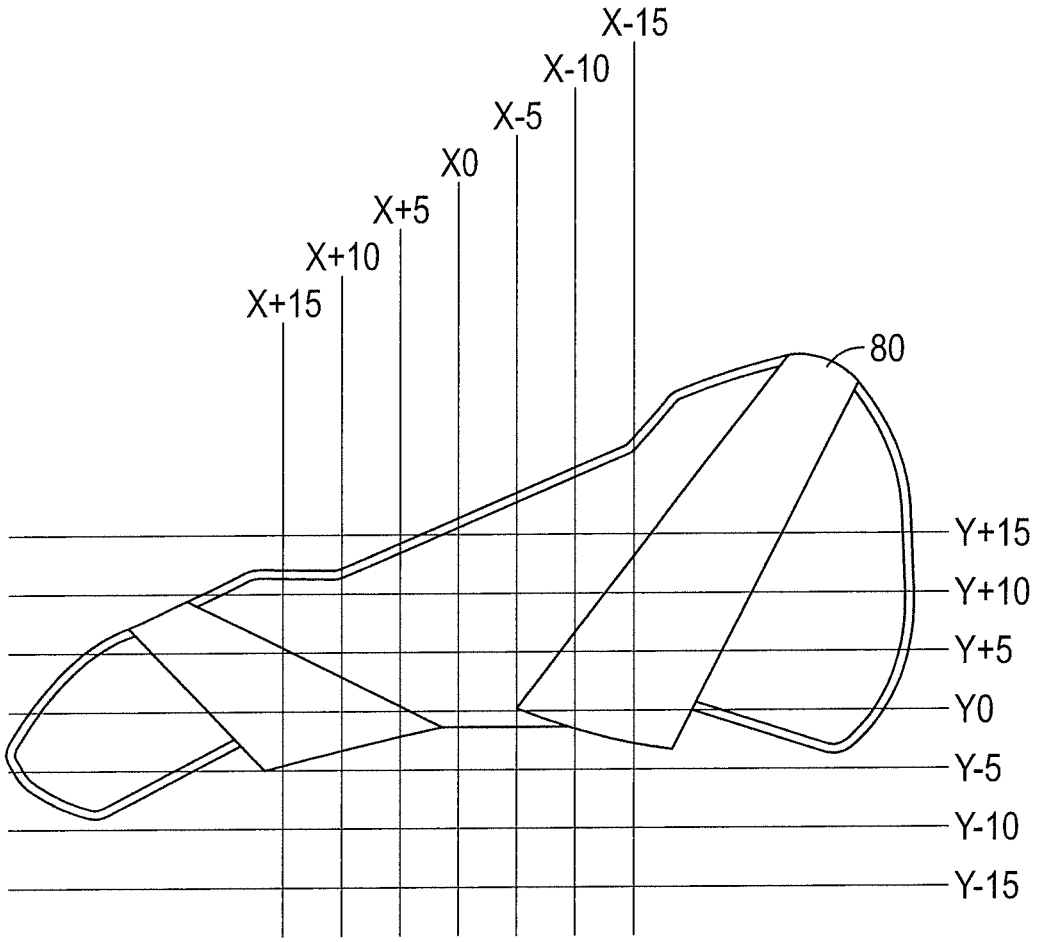
FIG. 9 is a top view of the badge of FIG. 7A with a x-y coordinate grid superimposed on top of the badge, in accordance with one embodiment of the invention.

FIG. 9 illustrates a perspective top view of the badge 80 with a x-y coordinate grid superimposed on top of the badge 80. The x-y grid is superimposed so that a center of the grid (i.e., 0, 0 coordinate) is located at a center of a club face (not shown) when the badge 80 is inserted in a rear cavity behind the club face. In accordance with various embodiments, the center of the club face can be determined using the procedures described in the USGA "Procedure for Measuring the Flexibility of a Golf Club head," Revision 2.0, Mar. 25, 2005. Alternatively, in some embodiments, the center of the club face corresponds to the "ideal striking location on the striking face" as described in paragraphs 0106-0109, for example, of U.S. Published Application No. 2013/0331201 A1, the content of which is incorporated by reference herein in its entirety. As shown in FIG. 9, the term "x axis" as used herein refers to a horizontal axis that is generally parallel with a ground plane when a sole of a golf club head is resting on the ground plane during a normal address position of the club head. In other words, the x-axis is generally parallel to the horizontal grooves located on the face of golf club iron when the sole of the golf club iron is resting on the ground. As used herein, "y axis" refers to a vertical axis that is perpendicular to the x axis as defined above.

The moments of inertia of a plane area, referred to herein as "area moments of inertia (I)," are physical parameters that are well-known to those of ordinary skill in the art. For example, the moment of inertia of a plane area is described in Chapter 12, section 12.4 entitled "Moments of Inertia of Plane Areas" of a textbook entitled"Mechanics of Materials, Fourth Edition" published 1997 by PWS Publishing Company. As discussed in further detail below, an area moment of inertia (I) measured in $mm^4$ was simulated for various differential x (dx) and differential y (dy) sections of the badge 80 with respect to an x axis ($I_1$) and a y axis ($I_2$). For example, for dx sections centered at x15 to x−15, area moments of inertia were simulated using a computer-aided design (CAD) simulation program for badges 80 designed for various sizes of iron club heads (4-PW) with respect to both the x axis ($I_1$) and y axis ($I_2$). Similarly, for dy sections centered at y15 to y−5, area moments of inertia were simulated using the CAD simulation program for badges 80 designed for various sizes of iron club heads (4-PW) with respect to both the x axis ($I_1$) and y axis ($I_2$). Note, that in the areas corresponding to y-coordinates y−10 and y−15, no sections of the badge 80 are present. Therefore, no values were obtained corresponding to these coordinates.

FIG. 10 illustrates a table of area moment of inertia (I) values simulated using a CAD simulation program at various dx and dy sections of the badge 80 on the x-y grid of FIG. 9 with respect to both the x axis ($I_1$ values) and the y axis ($I_2$ values), the axes being located when the badge 80 is inserted into a rear cavity of a corresponding iron club head, as discussed above. For purposes of FIG. 10, the "4" and "5" irons are grouped together as long-range irons for which I values were measured, the "6" and "7" irons are grouped together as mid-range irons for which I values were collectively measured, and the "8," "9" and "PW" irons are grouped together as short-range irons for which I values were collectively measured.

Figure 11A:
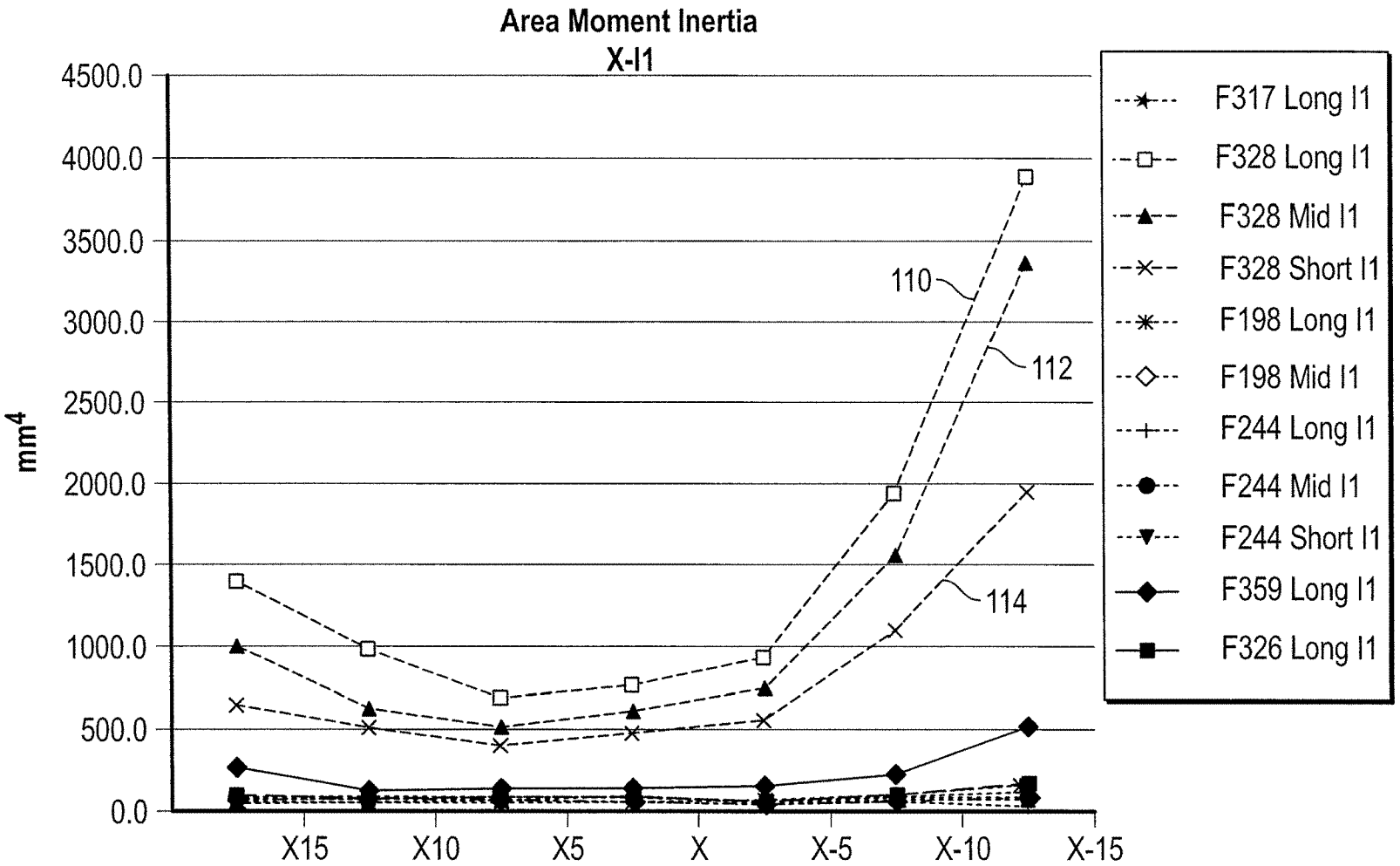
FIG. 11A shows a graph of area moment of inertia measurements taken along the x-axis of the grid of FIG. 9 for various club heads having various types of badges, including club heads with a badge in accordance with one embodiment of the invention.

FIG. 11A is a graph chart showing area moment of inertia values simulated for various dx sections of badge 80 as well as conventional badges with respect to the x axis ($I_1$ values). A first graph line 110 shows a curve of x axis area moment of inertia values ($mm^4$) of a badge 80 configured to be inserted into long-range irons. As shown in FIG. 11A, the badge 80 exhibits a maximum x axis area moment of inertia value of approximately 3900 $mm^4$ corresponding to the X−15 dx section and a minimum x axis area moment of inertia value of approximately 700 $mm^4$ corresponding to the X+5 dx section. A second graph line 112 shows a curve of x axis area moment of inertia values of a badge 80 configured for mid-range irons, with a maximum value of approximately 3400 $mm^4$ corresponding to the X−15 dx section and a minimum value of approximately 500 $mm^4$ corresponding to the X+5 dx section. A third graph line 114 shows a curve of x axis area moment of inertia values for a badge 80 configured for short-range irons, with a maximum value of approximately 2000 $mm^4$ corresponding to the X−15 dx section and a minimum value of approximately 400 $mm^4$ corresponding to the X+5 dx section.

Graphs of x axis area moment of inertia values for various conventional badges configured for long, mid and short-range irons are shown in the graph lines below the graph lines 110, 112 and 114. Based on these results, one can easily see that x axis area moment of inertia values simulated for dx sections of the badge 80 configured for various iron club head sizes are substantially greater than similar x axis area moment of inertia values for other types of conventional badges configured for similar iron club head sizes. Thus, the stiffer badge 80 when implemented into an iron club head 60 substantially increases the x-axis area moment of inertia ($I_x$) of the resulting club head, which means that the club head will exhibit significantly more damping of vibration and sound when it impacts a golf ball, resulting in better overall "feel" to a golfer that uses the golf club.

Figure 11B:
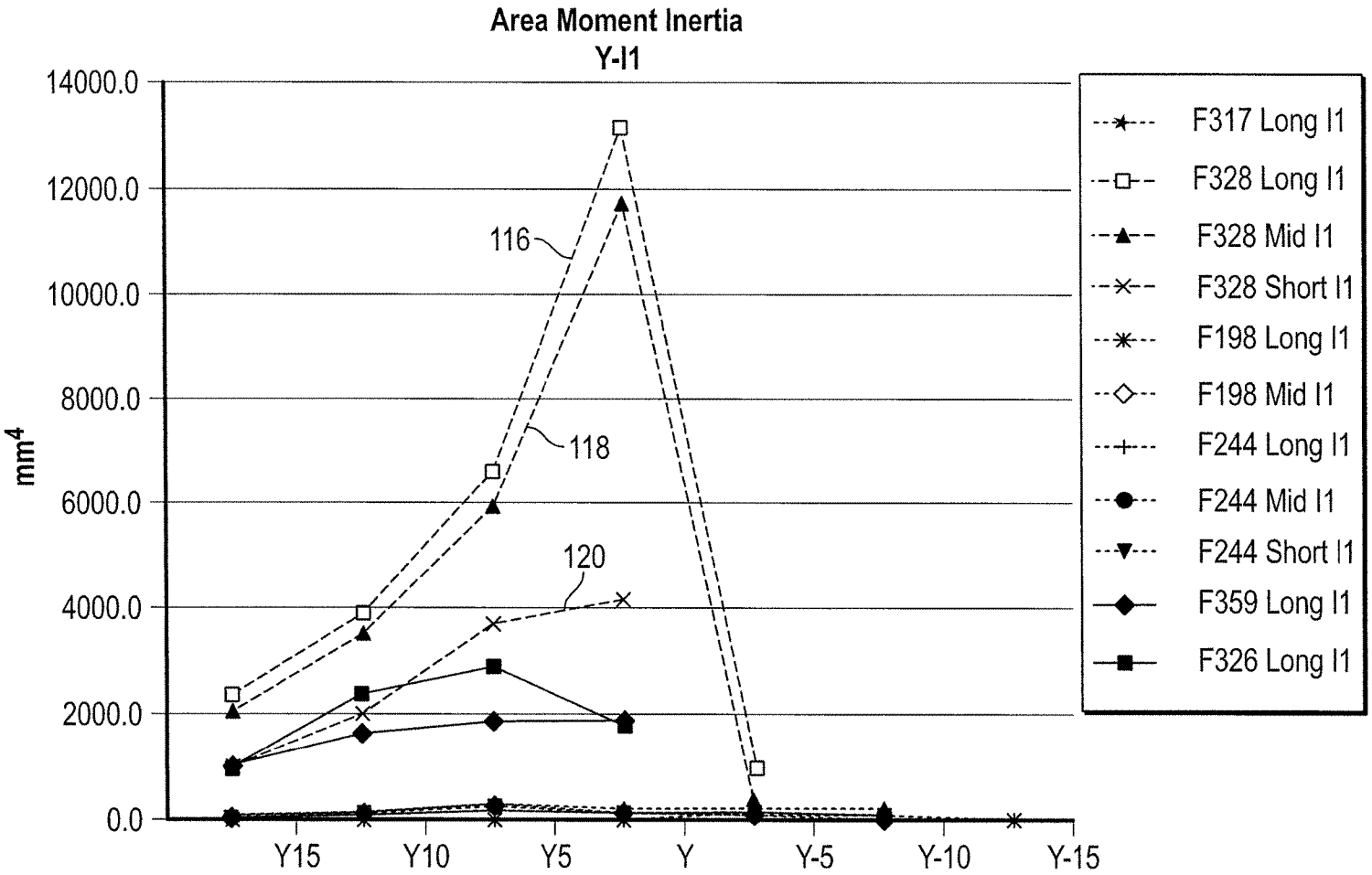
FIG. 11B shows a graph of area moment of inertia measurements taken along the y-axis of the grid of FIG. 9 for various club heads having various types of badges, including club heads with a badge in accordance with one embodiment of the invention.

FIG. 11B is a graph chart showing area moment of inertia values simulated for various dy sections of the badge 80 as well as conventional badges with respect to the x axis (i.e., $I_1$ values). A first graph line 116 shows a curve of x axis area moment of inertia values for a badge 80 configured for long-range irons, with a maximum value of approximately 13,000 $mm^4$ corresponding to the Y0 dy section of FIG. 9, and a minimum value of approximately 1000 $mm^4$ corresponding to the Y−5 dy section. A second graph line 118 shows a curve of x axis area moment of inertia values for a badge 80 configured for mid-range irons, with a maximum value of approximately 12,000 $mm^4$ corresponding to the Y0 dy section and a minimum x axis area moment of inertia value of approximately 245 $mm^4$ corresponding to the Y−5 dy section. A third graph line 120 shows a curve of x axis area moment of inertia values for a badge 80 configured for short-range irons, with a maximum value of approximately 4000 $mm^4$ corresponding to the Y−5 dy section and a minimum value of approximately 1000 $mm^4$ corresponding to the Y+15 dy section of the badge 80.

The x axis area moment of inertia values for conventional badges configured for similar iron type golf club head sizes are shown in the graph lines shown below graph lines 116, 118 and 120 in FIG. 11B. Based on these results, one can easily see that x axis area moment of inertia values simulated for dy sections of the badges 80 configured for various iron-type club head sizes are substantially greater than similar x axis area moment of inertia values for conventional badges configured for similar iron club head sizes, which means that the badge 80, in accordance with embodiments of the present invention, is significantly stiffer with respect to the x axis compared to conventional badges. Thus, a club head with badge 80 installed therein will exhibit significantly more damping of vibration and sound when it impacts a golf ball, resulting in better overall "feel" to a golfer that uses the golf club.

Figure 12A:
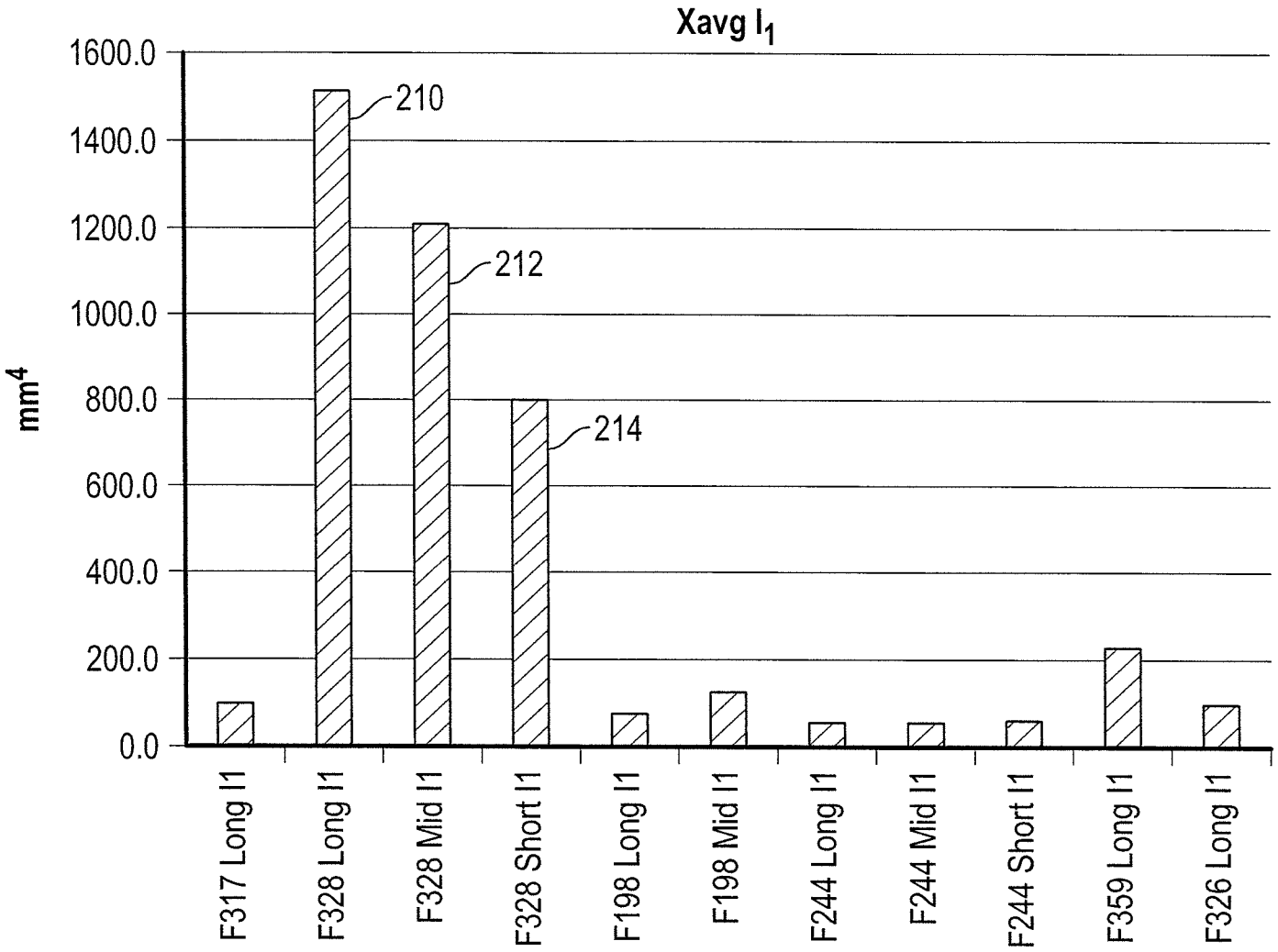
FIG. 12A shows a graph of average y-axis area moment of inertia values for various club heads, including club heads with a badge in accordance with one embodiment of the invention.

FIG. 12A illustrates a bar chart showing average area moment of inertia values with respect to the x axis simulated for various dx sections of badges configured to be inserted in various iron-type golf club heads (4-PW), including the badge 80, as discussed above. A first bar graph 210 shows that an average value of area moment of inertia with respect to the x axis simulated for various dx sections (i.e., vertically running dx strips in FIG. 9 when the sole portion 68 is grounded) of a badge 80 configured to be inserted into long-range iron golf club heads is approximately 1500 $mm^4$. A second bar graph 212 shows that an average value of area moment of inertia with respect to the x axis simulated for various dx sections of the badge 80 configured to be inserted into mid-range iron golf club heads is approximately 1200 $mm^4$. A third bar graph 214 shows that an average value of area moment of inertia with respect to the x axis simulated for various dx sections of the badge 80 configured to be inserted into short-range iron golf club heads is approximately 800 $mm^4$.

The remaining bar graphs in FIG. 12A show average values of x axis area moment of inertia simulated for dx sections of conventional badges configured to be inserted into various golf club iron heads. It is easy to see that the average values of area moment of inertia with respect to the x axis simulated for various dx sections of the badge 80 is significantly greater than average values of area moment of inertia with respect to the x axis simulated for various dx sections of conventional badges. Generally, the average value of area moment of inertia with respect to the x axis simulated for dx sections of the badge 80 is greater than 500 $mm^4$, which is far greater than such values for conventional badges. This confirms that the badge 80, in accordance with embodiments of the present invention, is significantly stiffer with respect to the x axis compared to conventional badges. Thus, a club head with badge 80 installed therein will exhibit significantly more damping of vibration and sound when it impacts a golf ball, resulting in better overall "feel" to a golfer that uses the golf club.

Figure 12B:
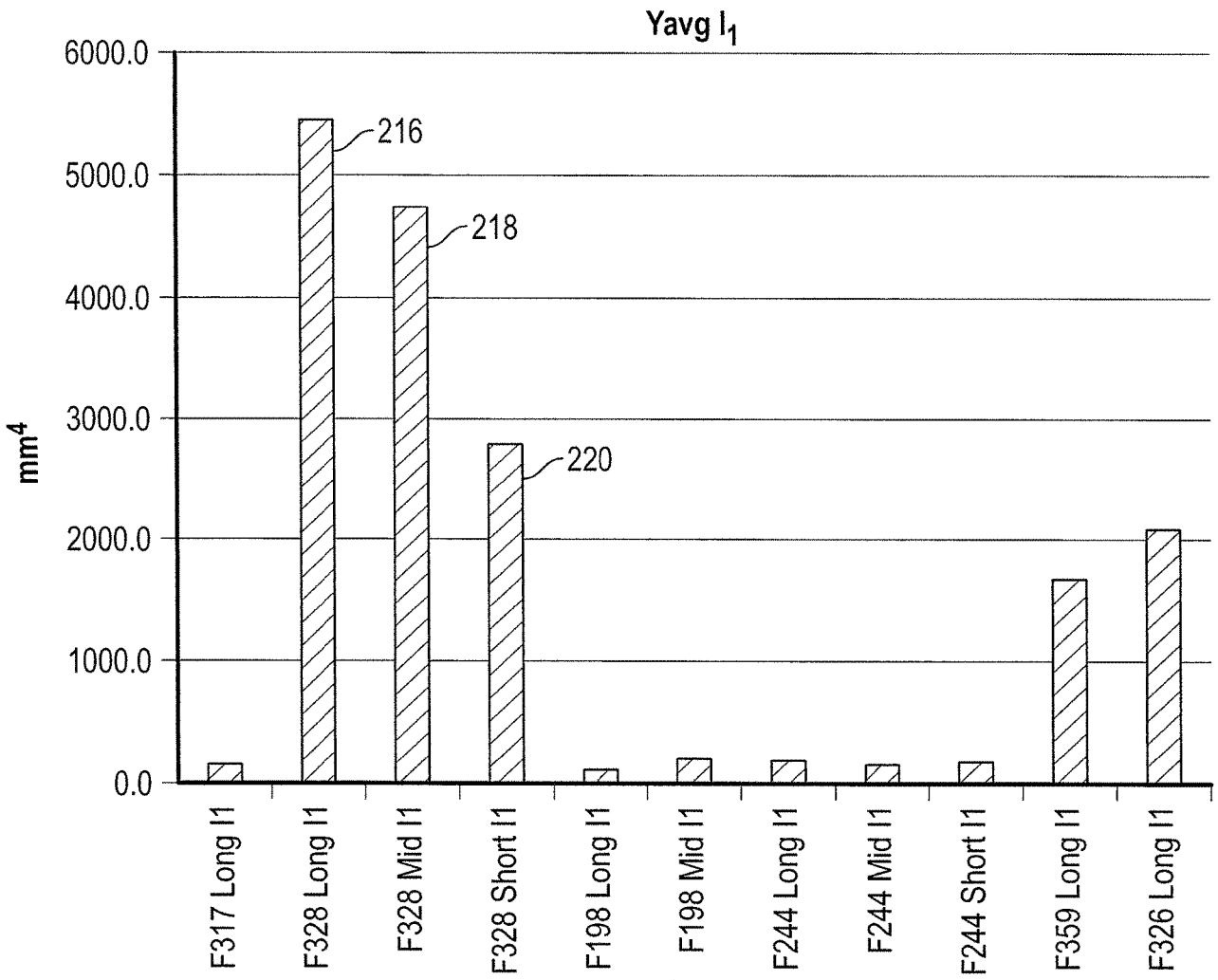
FIG. 12B shows a graph of average x-axis area moment of inertia values for various club heads, including club heads with a badge in accordance with one embodiment of the invention.

FIG. 12B illustrates a bar chart showing average area moment of inertia values with respect to the x axis simulated for differential y (dy) sections of various badges, including badge 80 installed in a rear cavity of various golf iron heads (4-PW), as discussed above. A first bar graph 216 shows that an average value of area moment of inertia with respect to the x axis simulated for dy sections (i.e., horizontally running dy strips in FIG. 9 when the sole portion 68 is grounded) of the badge 80 configured to be inserted into long-range iron golf club heads is approximately 5300 $mm^4$. A second bar graph 218 shows that an average value of area moment of inertia with respect to the x axis simulated for dy sections of the badge 80 configured to be inserted into mid-range iron golf club heads is approximately 4700 $mm^4$. A third bar graph 220 shows that an average value of area moment of inertia with respect to the x axis simulated for dy sections of the badge 80 configured to be inserted into short-range iron golf club heads is approximately 2800 $mm^4$.

The remaining bar graphs in FIG. 12B show average values of x axis area moment of inertia simulated for dy sections of various conventional badges configured to be inserted in similar types of golf club iron heads. It is easy to see that the average values of x axis area moment of inertia simulated for differential dy sections of the badge 80 is significantly greater than the corresponding values for conventional badges. Generally, the average value of area moment of inertia with respect to the x axis simulated for dy sections of the badge 80 is greater than 2500 $mm^4$, which is far greater than such values for conventional badges. This further confirms that the badge 80, in accordance with embodiments of the present invention, is significantly stiffer with respect to the x axis compared to conventional badges. Thus, a club head with badge 80 installed therein will exhibit significantly more damping of vibration and sound when it impacts a golf ball, resulting in better overall "feel" to a golfer that uses the golf club.

In certain embodiments of the golf club head 10 that include a separate striking plate attached to the body of the golf club head, the striking plate can be formed of forged maraging steel, maraging stainless steel, or precipitation-hardened (PH) stainless steel. In general, maraging steels have high strength, toughness, and malleability. Being low in carbon, they derive their strength from precipitation of inter-metallic substances other than carbon. The principle alloying element is nickel (15% to nearly 30%). Other alloying elements producing inter-metallic precipitates in these steels include cobalt, molybdenum, and titanium. In one embodiment, the maraging steel contains 18% nickel. Maraging stainless steels have less nickel than maraging steels but include significant chromium to inhibit rust. The chromium augments hardenability despite the reduced nickel content, which ensures the steel can transform to martensite when appropriately heat-treated. In another embodiment, a maraging stainless steel C455 is utilized as the striking plate. In other embodiments, the striking plate is a precipitation hardened stainless steel such as 17-4, 15-5, or 17-7.

The striking plate can be forged by hot press forging using any of the described materials in a progressive series of dies. After forging, the striking plate is subjected to heat-treatment. For example, 17-4 PH stainless steel forgings are heat treated by 1040° C. for 90 minutes and then solution quenched. In another example, C455 or C450 stainless steel forgings are solution heat-treated at 830° C. for 90 minutes and then quenched.

In some embodiments, the body of the golf club head is made from 17-4 steel. However another material such as carbon steel (e.g., 1020, 1030, 8620, or 1040 carbon steel), chrome-molybdenum steel (e.g., 4140 Cr—Mo steel), Ni—Cr—Mo steel (e.g., 8620 Ni—Cr—Mo steel), austenitic stainless steel (e.g., 304, N50, or N60 stainless steel (e.g., 410 stainless steel) can be used.

In addition to those noted above, some examples of metals and metal alloys that can be used to form the components of the parts described include, without limitation: titanium alloys (e.g., 3-2.5, 6-4, SP700, 15-3-3-3, 10-2-3, or other alpha/near alpha, alpha-beta, and beta/near beta titanium alloys), aluminum/aluminum alloys (e.g., 3000 series alloys, 5000 series alloys 6000 series alloys, such as 6061-T6, and 7000 series alloys, such as 7075), magnesium alloys, copper alloys, and nickel alloys.

In still other embodiments, the body and/or striking plate of the golf club head are made from fiber-reinforced polymeric composite materials, and are not required to be homogeneous. Examples of composite materials and golf club components comprising composite materials are described in U.S. Patent Application Publication No. 2011/0275451, which is incorporated herein by reference in its entirety.

The body of the golf club head can include various features such as weighting elements, cartridges, and/or inserts or applied bodies as used for CG placement, vibration control or damping, or acoustic control or damping. For example, U.S. Pat. No. 6,811,496, incorporated herein by reference in its entirety, discloses the attachment of mass altering pins or cartridge weighting elements.

For purposes of this description, certain aspects, advantages, and novel features of the embodiments of this disclosure are described herein. The disclosed methods, apparatuses, and systems should not be construed as limiting in any way. Instead, the present disclosure is directed toward all novel and nonobvious features and aspects of the various disclosed embodiments, alone and in various combinations and sub-combinations with one another. The methods, apparatuses, and systems are not limited to any specific aspect or feature or combination thereof, nor do the disclosed embodiments require that any one or more specific advantages be present or problems be solved.

As used herein, the term "and/or" used between the last two of a list of elements means any one or more of the listed elements. For example, the phrase "A, B, and/or C" means "A," "B," "C," "A and B," "A and C," "B and C" or "A, B and C."

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

What is claimed is:

1. A golf club head comprising:

a face portion surrounded by a topline portion, a toe portion, a sole portion and a heel portion, the face portion comprising a front striking surface and a back surface;

a backbar portion extending upwardly from the sole portion behind the face portion;

a rear cavity located behind the face portion and defined by inner peripheral walls of the topline portion, the toe portion, the sole portion, and the heel portion; and a badge coupled to the back surface of the face portion, the badge comprising a main body portion and at least one structural member extending outwardly from the main body portion, wherein the at least one structural member comprises an upper portion and a lower portion disposed between the topline portion and the sole portion, and wherein the at least one structural member has a maximum height above the main body portion in the range of 8 to 20 millimeters (mm) at the lower portion and a minimum height in the range of 2 to 8 mm at the upper portion;

wherein:

the badge is disposed within the rear cavity;

the main body portion of the badge further comprises a toe-side peripheral edge that is sized and shaped to conform to an inner peripheral wall of the toe portion;

the main body portion of badge further comprises a heel-side peripheral edge that is sized and shaped to conform to an inner peripheral wall of the heel portion;

the backbar portion includes at least one recess configured to receive the lower portion of the at least one structural member of the badge and a damping material; and the damping material is disposed within the at least one recess of the backbar portion and between the lower portion of the at least one structural member of the badge and the backbar portion.

2. The golf club head of claim 1, wherein the rear cavity includes a lower cavity portion and no portion of the badge occupies the lower cavity portion.

3. The golf club head of claim 2, wherein the at least one structural member comprises:

a first structural member located adjacent the toe portion, wherein the first structural member comprises a first lower portion coupled to the backbar portion and a first upper portion disposed between the topline portion and the first lower portion, and wherein the first structural member has a maximum height above the main body portion at the first lower portion and decreases in height from the first lower portion toward the first upper portion; and a second structural member located adjacent the heel portion, wherein the second structural member comprises a second lower portion coupled to the backbar portion and a second upper portion disposed between the topline portion and the second lower portion, and wherein the second structural member has a maximum height above the main body portion at the second lower portion and decreases in height from the second lower portion toward the second upper portion.

4. The golf club head of claim 3, wherein the first and second structural members are each oriented substantially vertically when the sole portion of the golf club head is grounded.

5. The golf club head of claim 4, wherein:

the first structural member is disposed behind the face portion at a first antinode of the face portion; and the second structural member is disposed behind the face portion at a second antinode of the face portion.

6. The golf club head of claim 3, wherein:

the damping material is a first damping material and is disposed between the first lower portion and the backbar portion; and the golf club head further comprises a second damping material disposed between the second lower portion and the backbar portion.

7. The golf club head of claim 6, wherein the first and second damping materials each comprise double-sided tape that fixes the first and second lower portions, respectively, to the backbar portion.

8. The golf club head of claim 3, wherein the first and second structural members are oriented substantially in a "V" configuration with respect to one another when the sole portion of the golf club head is grounded.

9. The golf club head of claim 8 further comprising a bridge structure disposed between and coupling the first lower portion to the second lower portion.

10. The golf club head of claim 8, wherein:

the first structural member has a maximum width at the first lower portion and gradually decreases in width from the first lower portion toward the first upper portion; and the second structural member has a maximum width at the second lower portion and gradually decreases in width from the second lower portion toward the second upper portion.

11. The golf club head of claim 10, wherein:

the first structural member has a first cutout portion therein; and the second structural member has a second cutout portion therein.

12. The golf club head of claim 8, wherein the badge has a mass of less than 15.0 grams.

13. The golf club head of claim 2, wherein the badge has a mass of no more than 12 grams.

14. The golf club head of claim 13, wherein a maximum thickness of the face portion is no more than 3.6 mm.

15. The golf club head of claim 14, wherein at least a portion of the front striking surface is formed of a separate striking plate, wherein the separate striking plate is formed from a low in carbon steel.

16. A golf club head comprising:

a face portion surrounded by a topline portion, a toe portion, a sole portion and a heel portion, the face portion comprising a front striking surface and a back surface;

a backbar portion extending upwardly from the sole portion behind the face portion; and a rear cavity located behind the face portion and defined by inner peripheral walls of the topline portion, the toe portion, the sole portion and the heel portion; and a badge coupled to the back surface of the face portion and disposed within the rear cavity, the badge comprising:

a main body portion;

a first structural member located adjacent the toe portion and extending outwardly from the main body portion away from the face portion; and a second structural member located adjacent the heel portion and extending outwardly from the main body portion away from the face portion, wherein the first and second structural members each has a maximum height above the main body portion in the range of 8 to 20 millimeters (mm) and a minimum height in the range of 2 to 8 mm;

wherein the rear cavity includes a lower cavity portion and no portion of the badge occupies the lower cavity portion.

17. The golf club head of claim 16, wherein:

the first structural member comprises a first lower portion coupled to the backbar portion and a first upper portion disposed between the topline portion and the first lower portion, and wherein the first structural member has the maximum height above the main body portion at the first lower portion and decreases in height from the first lower portion toward the first upper portion; and the second structural member comprises a second lower portion coupled to the backbar portion and a second upper portion disposed between the topline portion and the second lower portion, and wherein the second structural member has the maximum height above the main body portion at the second lower portion and decreases in height from the second lower portion toward the second upper portion.

18. The golf club head of claim 17 further comprising a bridge structure disposed between and coupling the first lower portion to the second lower portion.

19. The golf club head of claim 17, wherein:

the first structural member has a maximum width at the first lower portion and gradually decreases in width from the first lower portion toward the first upper portion; and the second structural member has a maximum width at the second lower portion and gradually decreases in width from the second lower portion toward the second upper portion.

20. The golf club head of claim 16, wherein:

the first structural member has a first cutout portion therein; and the second structural member has a second cutout portion therein.

21. The golf club head of claim 16, wherein the badge has a mass of less than 15.0 grams.

22. The golf club head of claim 16, wherein the badge has a mass of no more than 12 grams.

23. The golf club head of claim 16, wherein a maximum thickness of the face portion is no more than 3.6 mm.

24. The golf club head of claim 16, wherein at least a portion of the front striking surface is formed of a separate striking plate, wherein the separate striking plate is formed from a low in carbon steel.

* * * * *